US011798525B2

(12) United States Patent
Goto

(10) Patent No.: US 11,798,525 B2
(45) Date of Patent: Oct. 24, 2023

(54) SOUND EMITTING APPARATUS AND BLADE NOISE REDUCTION APPARATUS

(71) Applicant: KABUSHIKI KAISHA TOSHIBA, Tokyo (JP)

(72) Inventor: Tatsuhiko Goto, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 17/651,085

(22) Filed: Feb. 15, 2022

(65) Prior Publication Data

US 2023/0070698 A1 Mar. 9, 2023

(30) Foreign Application Priority Data

Sep. 7, 2021 (JP) ..... 2021-145266

(51) Int. Cl.
*G10K 11/178* (2006.01)
*G10K 11/172* (2006.01)

(52) U.S. Cl.
CPC ..... *G10K 11/17823* (2018.01); *G10K 11/172* (2013.01); *G10K 11/17881* (2018.01); *G10K 11/17854* (2018.01); *G10K 2210/3026* (2013.01); *G10K 2210/3027* (2013.01); *G10K 2210/3028* (2013.01); *G10K 2210/3044* (2013.01)

(58) Field of Classification Search
None
See application file for complete search history.

(56) References Cited

U.S. PATENT DOCUMENTS

| | | | | |
|---|---|---|---|---|
| 10,225,644 | B2 | 3/2019 | Goto et al. | |
| 2005/0205349 | A1* | 9/2005 | Parker | H04R 1/2857 381/338 |
| 2015/0319523 | A1 | 11/2015 | Kano et al. | |
| 2018/0280199 | A1* | 10/2018 | Merkur | G10K 11/16 |
| 2018/0324511 | A1 | 11/2018 | Asada et al. | |
| 2019/0051284 | A1* | 2/2019 | Magariyachi | H04R 1/345 |
| 2022/0093076 | A1* | 3/2022 | Mathur | H04R 1/403 |
| 2022/0301539 | A1 | 9/2022 | Goto | |

FOREIGN PATENT DOCUMENTS

| | | | |
|---|---|---|---|
| JP | 10-169599 | A | 6/1998 |
| JP | 2001-054181 | A | 2/2001 |
| JP | 3876011 | B2 | 1/2007 |
| JP | 4195751 | B2 | 12/2008 |
| JP | 4295238 | B2 | 7/2009 |
| JP | 2011-244030 | A | 12/2011 |
| JP | 5215797 | B2 | 6/2013 |
| JP | WO2017/090311 | A1 | 6/2017 |
| JP | 2017-204812 | A | 11/2017 |

(Continued)

*Primary Examiner* — Kenny H Truong
(74) *Attorney, Agent, or Firm* — Oblon, McClelland, Maier & Neustadt, L.L.P.

(57) ABSTRACT

According to an embodiment, a sound emitting apparatus includes a helical hollow tube and at least three sound wave sources. The helical hollow tube helically extends in a circumferential direction to form an annular shape as a whole. The first helical hollow tube includes a plurality of openings. The at least three sound wave sources are coupled to the first helical hollow tube and are configured to supply a sound wave to the first helical hollow tube.

10 Claims, 26 Drawing Sheets

(56) References Cited

FOREIGN PATENT DOCUMENTS

| | | | |
|---|---|---|---|
| JP | WO2018/003394 | A1 | 1/2018 |
| JP | 6503135 | B1 | 4/2019 |
| JP | 6593741 | B2 | 10/2019 |
| JP | 3231067 | U | 3/2021 |
| JP | 2022-143056 | A | 10/2022 |

* cited by examiner

SOUND EMITTING APPARATUS AND BLADE NOISE REDUCTION APPARATUS

CROSS-REFERENCE TO RELATED APPLICATIONS

This application is based upon and claims the benefit of priority from Japanese Patent Application No. 2021-145266, filed Sep. 7, 2021, the entire contents of which are incorporated herein by reference.

FIELD

Embodiments described herein relate generally to a sound emitting apparatus and a blade noise reduction apparatus.

BACKGROUND

When an active noise reduction method is used to reduce a blade noise, a blade rotation mode is simulated using a plurality of loudspeakers installed coaxially with the rotation axis of rotational blades. For example, to reduce a noise generated in an Mth-order Lobe mode, 2M+1 or more loudspeakers are discretely arranged. When loudspeakers are used for blade noise reduction, jigs for installing the loudspeakers are required around the rotational blades, and the entire load becomes heavy due to the weights of the loudspeakers. In addition, the loudspeaker installation volume may disturb the sound field and the flow of the blades.

DETAILED DESCRIPTION

Figure 1:
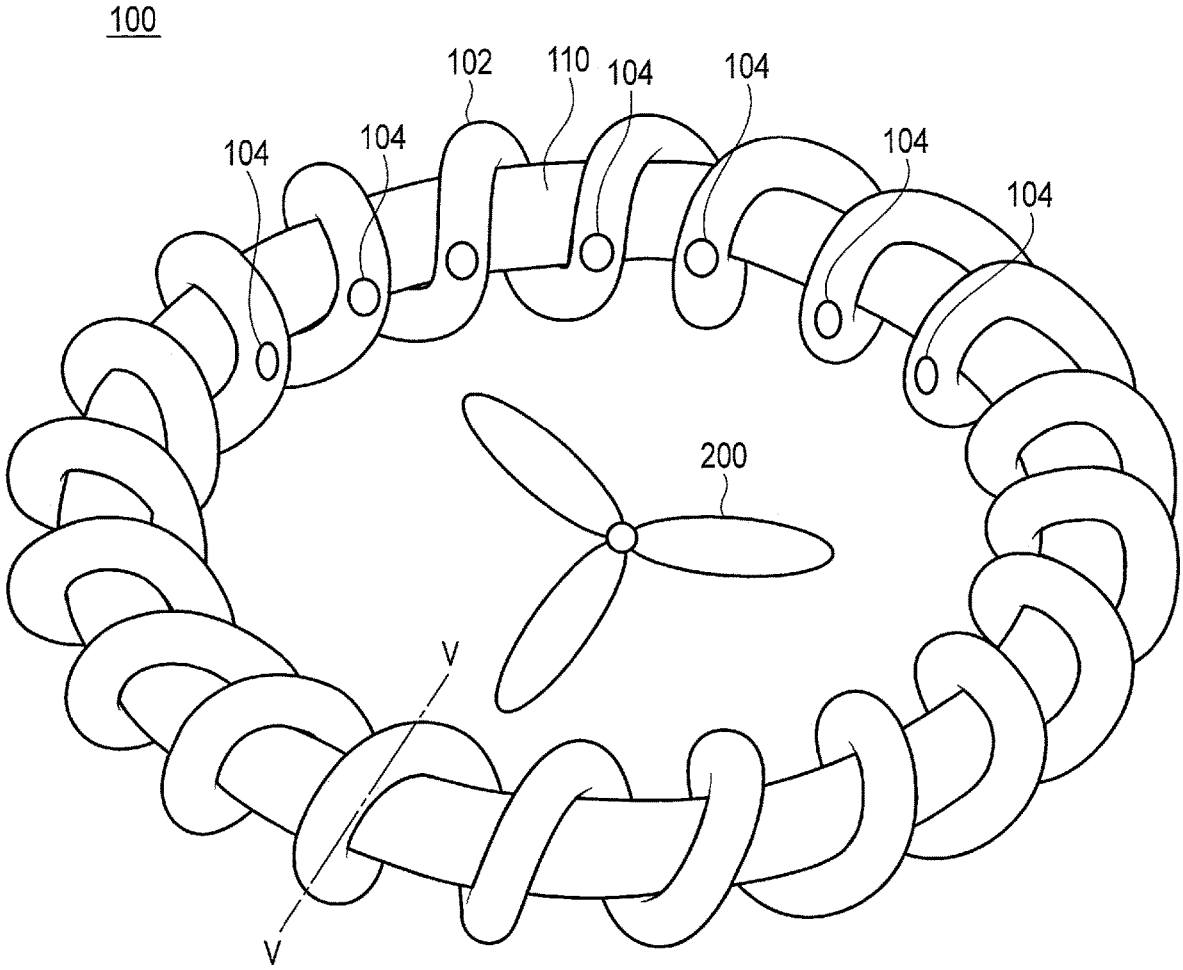
FIG. 1 is a perspective view showing a sound emitting apparatus according to an embodiment.

According to an embodiment, a sound emitting apparatus includes a helical hollow tube and at least three sound wave sources. The helical hollow tube helically extends in a circumferential direction to form an annular shape as a whole. The first helical hollow tube includes a plurality of openings. The at least three sound wave sources are coupled to the first helical hollow tube and are configured to supply a sound wave to the first helical hollow tube.

Hereinafter, embodiments will be described with reference to the accompanying drawings. In order to avoid redundant description, like reference numerals are given to like components throughout the drawings. In addition, branch numbers are attached to the reference numerals in order to distinguish individual components. In some drawings, one or more components are not shown for simplicity.

An embodiment is directed to a sound emitting apparatus that emits a sound. The sound emitting apparatus according to the embodiment can be used for applications such as blade noise reduction and an alarm buzzer. The blade noise is a noise generated by rotation of one or more rotational blades such as the propeller of a drone or a propeller fan. The blade noise includes noises generated in a plurality of Lobe modes. The following description is made on the assumption that the sound emitting apparatus is used for blade noise reduction.

Figure 2:
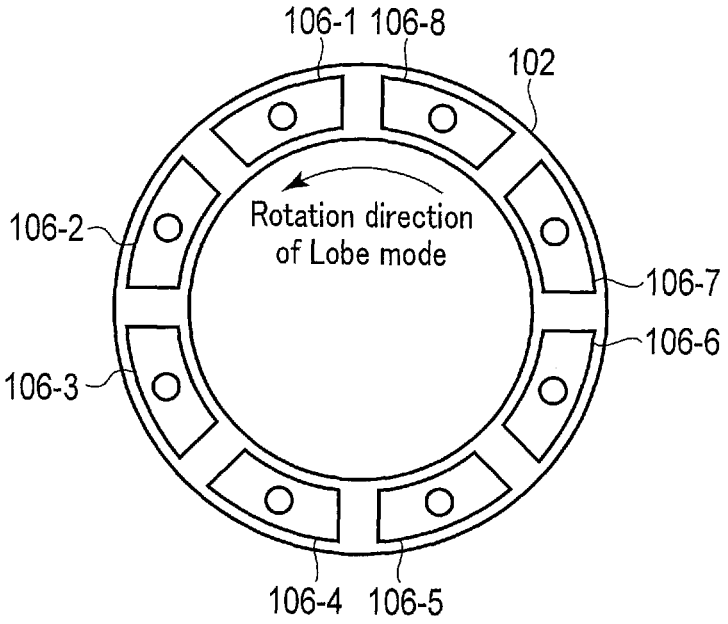
FIG. 2 is a plan view showing the sound emitting apparatus in FIG. 1.

FIGS. 1 and 2 schematically show an example of the configuration of a sound emitting apparatus 100 according to an embodiment. As shown in FIGS. 1 and 2, the sound emitting apparatus 100 includes a hollow tube 102, three or more sound wave sources 106, and an annular member 110. In the example shown in FIG. 2, eight sound wave sources 106-1 to 106-8 are provided. When a noise reduction target is the Mth-order Lobe mode, 2M+1 or more sound wave sources 106 are provided. The sound emitting apparatus 100 is annular, and a fan 200 serving as a noise source is arranged inside the sound emitting apparatus 100. The fan 200 includes one or more rotational blades.

The hollow tube 102 has an annular or ring shape as a whole. The hollow tube 102 is a looped helical hollow tube helically extending in the circumferential direction. The circumferential direction corresponds to the rotation direction of the fan 200. The section of the hollow tube 102 may be circular. That is, the hollow tube 102 may be a hollow circular tube. The hollow tube 102 has a plurality of openings 104 that make the internal and external spaces of the hollow tube 102 communicate with each other. The openings 104 are formed to face the fan 200. In other words, the openings 104 are formed on the inner side of the hollow tube 102.

The hollow tube 102 has a tube line length dependent on a frequency subjected to noise reduction (specifically, a frequency corresponding to a Lobe mode subjected to noise reduction) such that a natural frequency corresponding to a spatial sound field (Lobe mode) excited in the hollow tube 102 matches the frequency subjected to noise reduction. The tube line length means a dimension of the hollow tube 102 along its central axis. In the following description, a Lobe mode subjected to noise reduction is sometimes referred to as a target Lobe mode, and a frequency subjected to noise reduction is sometimes referred to as a target frequency. The natural frequency matching the target frequency means that the natural frequency is within a frequency range having a predetermined width around the target frequency. For example, when the target frequency is f [Hz], the natural frequency is set to a value within a frequency range from (f−100) Hz to (f+100) Hz.

The annular member 110 is an annular supporting member that supports the hollow tube 102. The hollow tube 102 is helically wound on the annular member 110. The annular member 110 may be a hollow tube. From the viewpoint of space saving, the sound wave sources 106 are desirably provided in the internal space of the annular member 110. Note that the sound wave sources 106 may be provided outside the annular member 110.

Figure 3:
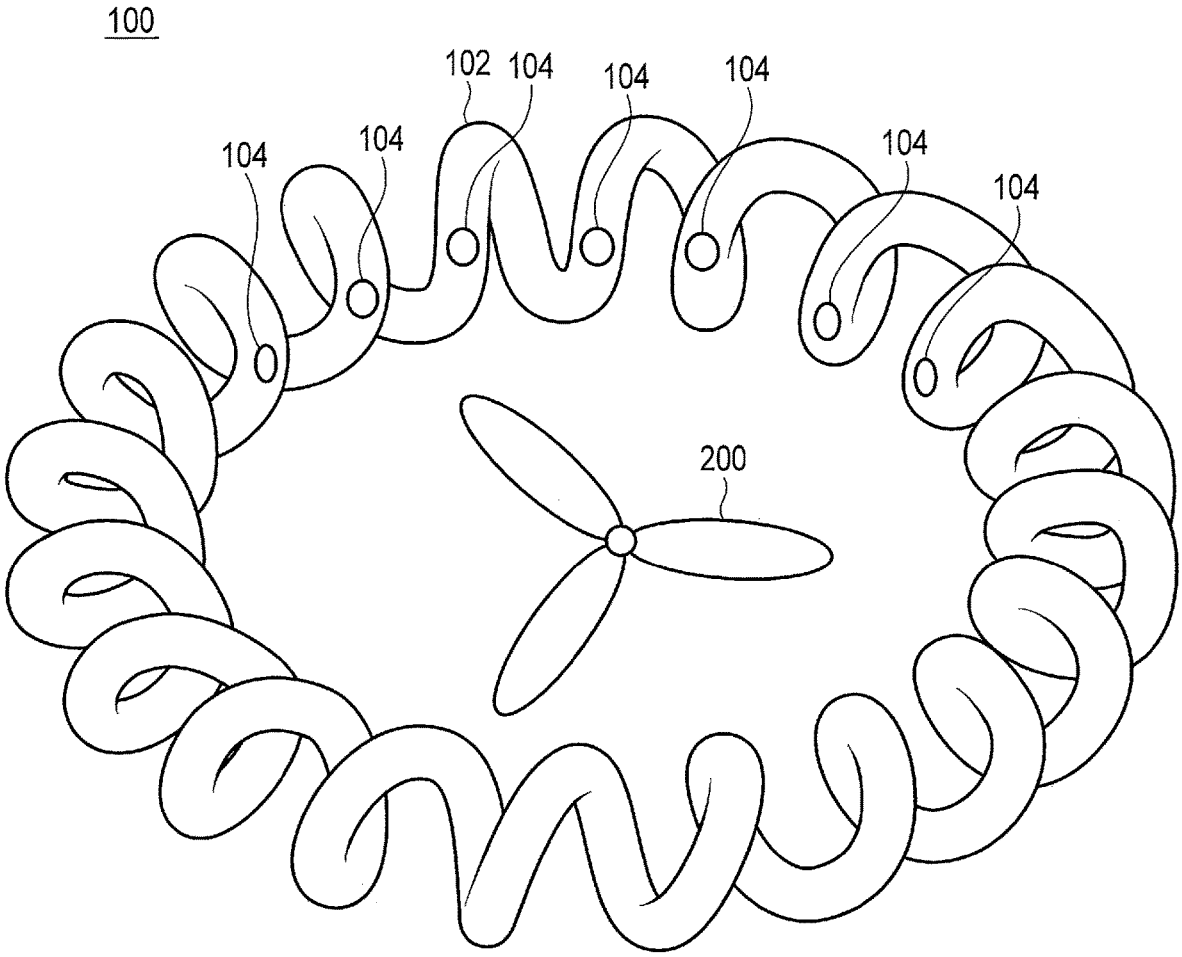
FIG. 3 is a perspective view showing the sound emitting apparatus according to an embodiment.

In the example shown in FIG. 1, the hollow tube 102 may be fabricated by fabricating a flexible hollow tube, helically winding it on the annular member 110, and joining the two ends of the hollow tube. Alternatively, the hollow tube 102 may be fabricated using a 3D printer. In this case, the annular member 110 may be omitted, as shown in FIG. 3.

In the example shown in FIG. 1, the entire shape of the hollow tube 102 is circular. Alternatively, the entire shape of the hollow tube 102 may be oval. For example, the supporting member is oval, and the hollow tube 102 is helically wound on the supporting member.

The sound wave sources 106 are connected to the hollow tube 102 and supply sound waves to the hollow tube 102. The sound wave sources 106 are arranged in the hollow tube 102 at predetermined angular intervals. The angular interval refers to an interval in the circumferential direction and is expressed by an angle with respect to the center. In the example shown in FIG. 2, the sound wave sources 106-1 to 106-8 are arranged in the hollow tube 102 at angular intervals of 45°.

Figure 4:
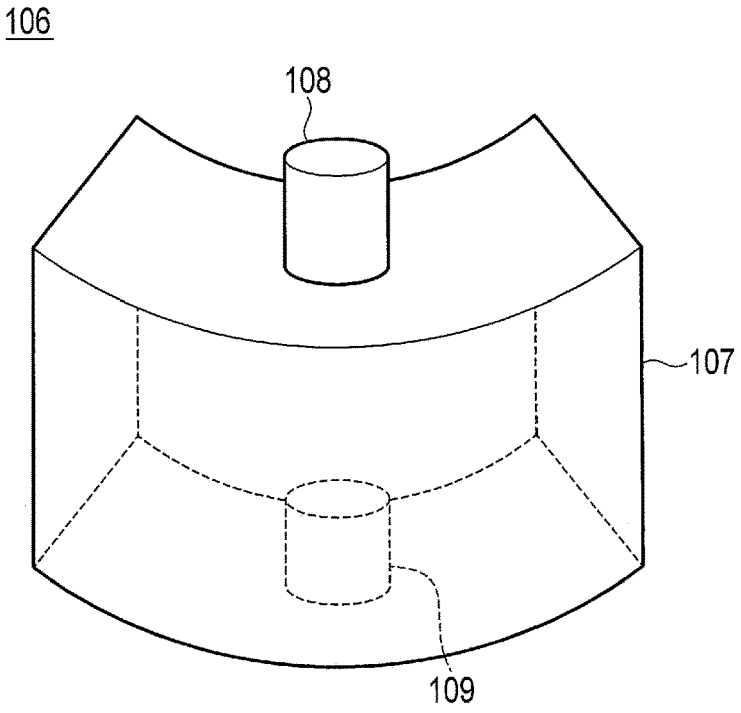
FIG. 4 is a perspective view showing a sound wave source shown in FIG. 2.

FIG. 4 schematically shows an example of the sound wave source 106. In the example shown in FIG. 4, the sound wave source 106 includes an enclosure part 107 having an internal space, a connecting tube 108 that makes the internal space of the enclosure part 107 and that of the hollow tube 102 communicate with each other, and a loudspeaker 109 provided in the internal space of the enclosure part 107. The loudspeaker 109 is a transducer that converts an electric signal into a sound. The loudspeaker 109 may be a compact loudspeaker such as a loudspeaker having a voice coil or a loudspeaker having a piezoelectric element. The enclosure part 107 may be designed to generate resonance in order to increase the volume. Specifically, the dimensions of the enclosure part 107 may be designed in accordance with a target frequency.

Figure 5:
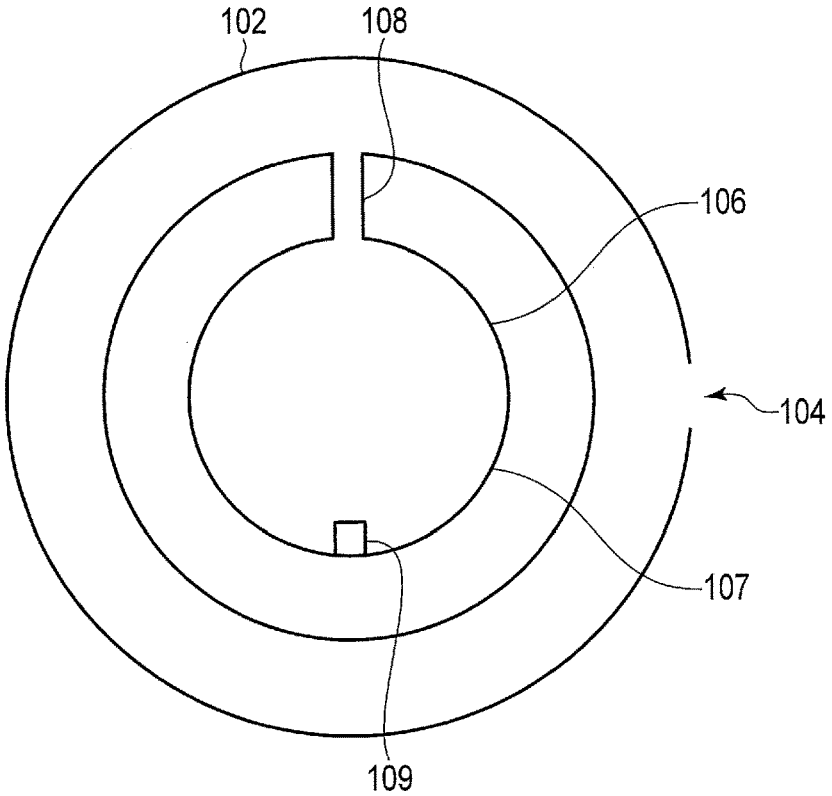
FIG. 5 is a sectional view of the sound emitting apparatus in FIG. 1.

FIG. 5 schematically shows a cross section of the sound emitting apparatus 100 taken along a line V-V in FIG. 1 when the sound wave source 106 has the structure shown in FIG. 4. As shown in FIG. 5, a sound emitted from the loudspeaker 109 is supplied to the hollow tube 102 through the connecting tube 108, exciting a spatial sound field corresponding to a target Lobe mode in the hollow tube 102. The spatial sound field excited in the hollow tube 102 is output from the hollow tube 102 to the external space through the openings 104.

The structure of the sound wave source 106 shown in FIG. 5 is merely an example. As the sound wave source 106, a canal type earphone may be used. The earphone is connected to the hollow tube 102 at the canal part of the earphone.

Figure 6:
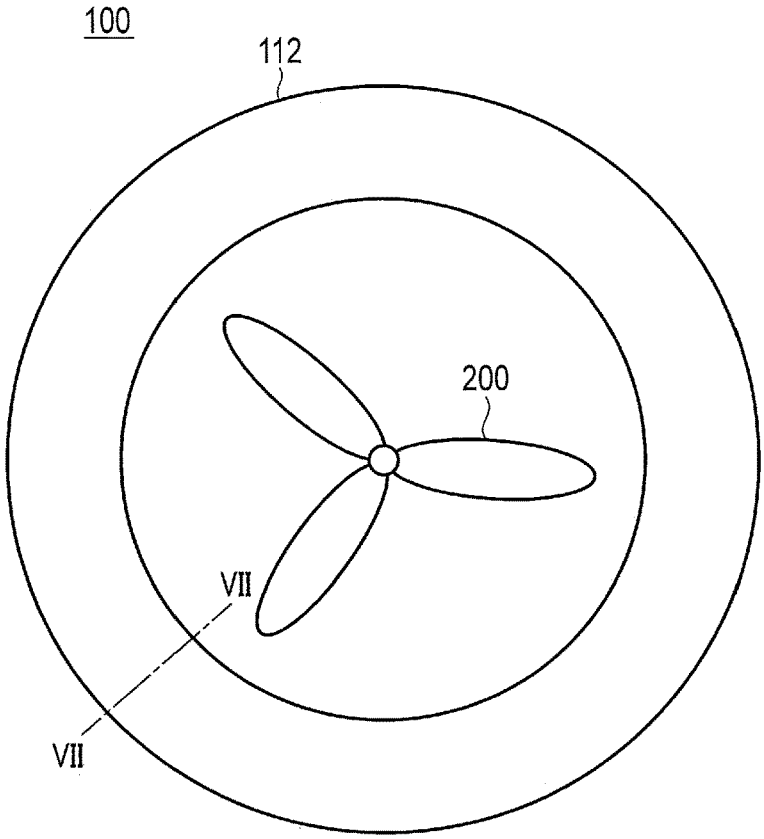
FIG. 6 is a plan view showing the sound emitting apparatus according to an embodiment.
Figure 7:
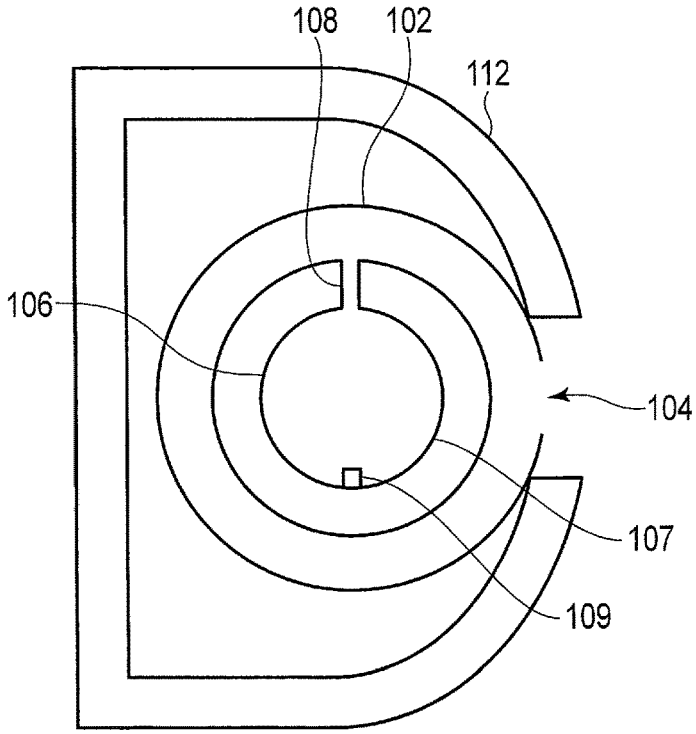
FIG. 7 is a sectional view of the sound emitting apparatus in FIG. 6.

As shown in FIGS. 6 and 7, the sound emitting apparatus 100 may further include a cover 112 covering the hollow tube 102. FIG. 7 schematically shows a cross section of the sound emitting apparatus 100 taken along a line VII-VII in FIG. 6. The cover 112 has a plurality of openings facing the openings 104 of the hollow tube 102. The hollow tube 102 disturbs an air flow due to its complicated structure and thus disturbs the flow of rotational blades. The cover 112 covering the hollow tube 102 prevents the disturbance of the flow of the rotational blades. The cover 112 may have the function of a bellmouth to effectively prevent the disturbance of the flow of the rotational blades. Specifically, the cover 112 may have a shape curved convexly toward the fan 200.

The hollow tube 102 and the cover 112 may be integrally formed. For example, a combination of the hollow tube 102 and cover 112 may be fabricated by fabricating upper and lower members by a 3D printer, attaching the sound wave source 106 to the upper or lower member, and joining the upper and lower members to each other. The top and bottom are defined along the rotating axis of the fan 200.

The sound emitting apparatus 100 further includes a control circuit that controls the sound wave sources 106. For example, the control circuit generates drive signals for driving the sound wave sources 106, and sends the drive signals to the sound wave sources 106. There is a phase difference between drive signals for the two sound wave sources 106 separated by the predetermined angular interval, which depends on the order M of the target Lobe mode and the predetermined angular interval. Thus, the sound field excited in the hollow tube 102 rotates in the circumferential direction, and the Lobe mode characteristics of the blade noise can be simulated. The sound emitting apparatus 100 is configured to excite a Lobe mode of an order equal to the order of the target Lobe mode. For example, when the target Lobe mode is the fourth-order Lobe mode, the sound emitting apparatus 100 is configured to excite the fourth-order Lobe mode in the hollow tube 102.

As an example, the control circuit includes a processing circuit and a memory. The processing circuit includes, for example, a general-purpose processor such as a CPU (Central Processing Unit). The memory includes a volatile memory and a nonvolatile memory, and stores data such as a control program. At least part of processing to be described below regarding the control circuit can be implemented by executing a control program by the general-purpose processor. The control circuit may include a dedicated processor such as an ASIC (Application Specific Integrated Circuit) or a FPGA (Field Programmable Gate Array) instead of or in addition to the general-purpose processor.

Figure 8:
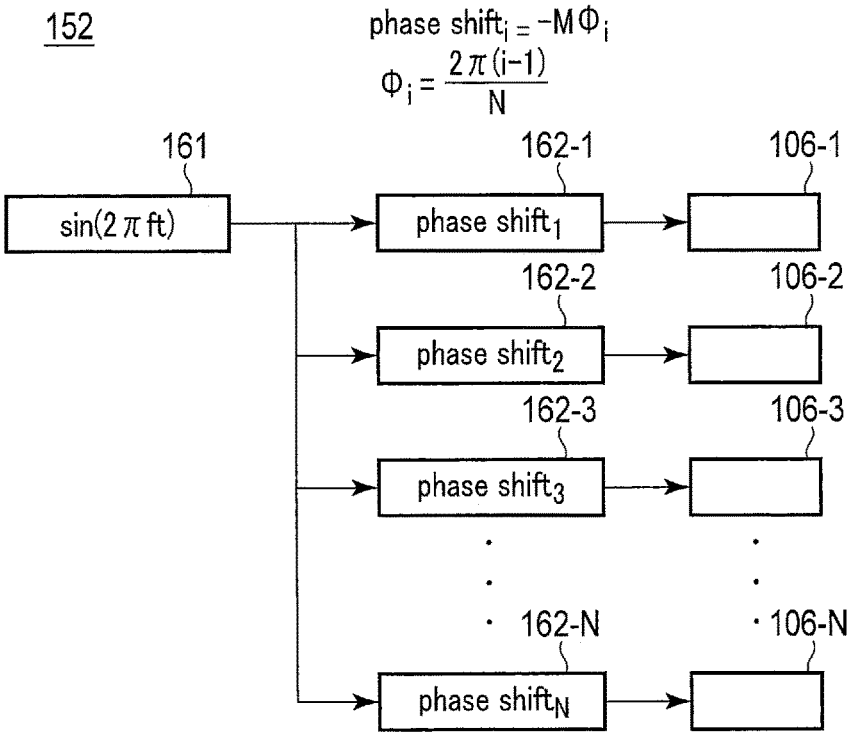
FIG. 8 is a block diagram showing an example of a drive circuit that drives the sound wave source shown in FIG. 2.

FIG. 8 schematically shows an example of the configuration of a drive circuit 152 included in the control circuit. In the example shown in FIG. 8, the drive circuit 152 includes a drive signal generation unit 161 and phase shifters 162-1 to 162-N. The drive signal generation unit 161 generates a drive signal. The drive signal is branched into N and supplied to the phase shifters 162-1 to 162-N. The phase shifter **162-*i* applies a phase shift to the drive signal, where $\phi_i=2\pi(i-1)/N$, M is the order of the Lobe mode, and N is the number of sound wave sources 106. The drive signal to which the phase shift $-M\phi_i$ is applied by the phase shifter 162-*i* is sent to the sound wave source 106-*i***.

Figure 9:
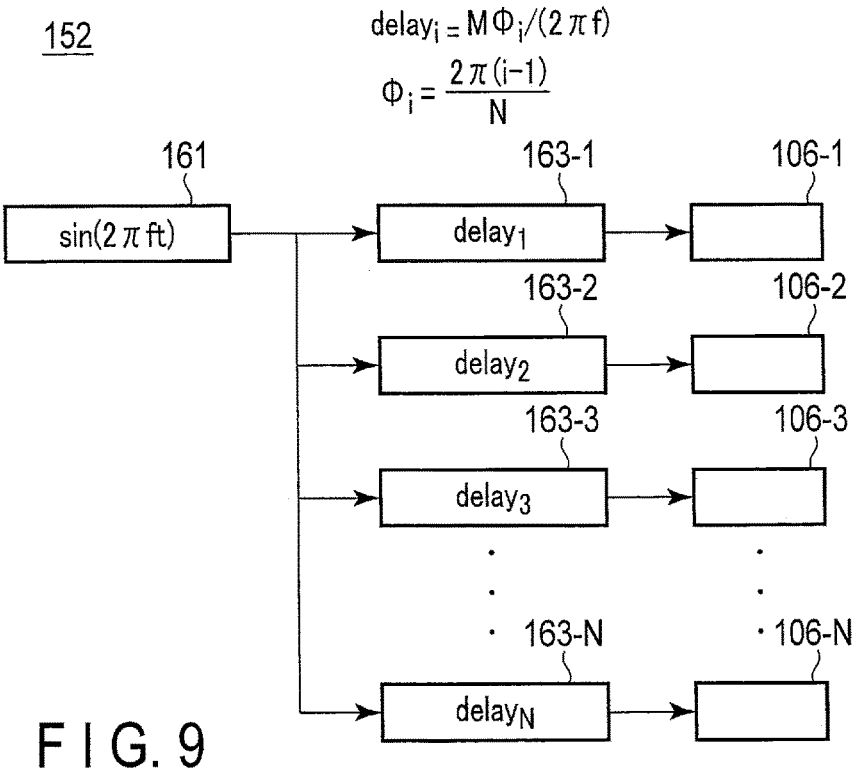
FIG. 9 is a block diagram showing another example of the drive circuit that drives the sound wave source shown in FIG. 2.

FIG. 9 schematically shows another example of the arrangement of the drive circuit 152 included in the control circuit. In the example shown in FIG. 9, the drive circuit 152 includes the drive signal generation unit 161 and delay units 163-1 to 163-N. The drive signal output from the drive signal generation unit 161 is branched into N and supplied to the delay units 163-1 to 163-N. The delay unit **163-*i* delays the drive signal by a time $M\phi_i/2\pi f$, where $\phi_i=2\pi(i-1)/N$, and f is the frequency of the drive signal. The drive signal delayed by the time $M\phi_i/2\pi f$ by the delay unit 163-*i* is sent to the sound wave source 106-*i***.

The sound emitting apparatus 100 having the above-described configuration can emit a sound for reducing the noise of a target Lobe mode. The hollow tube 102 having an internal space can implement a lightweight apparatus. As described above, the hollow tube 102 has a tube line length dependent on a target frequency. When the hollow tube 102 is a simple annular ring, the dimension (Specifically, radius) of the annular ring increases in proportion to the tube line length of the hollow tube 102. The dimension of the annular ring can be kept small by helically shaping the hollow tube 102. This can implement a compact apparatus.

[Design of Helical Hollow Tube]

Next, a method of designing the hollow tube 102 will be explained.

Figure 10:
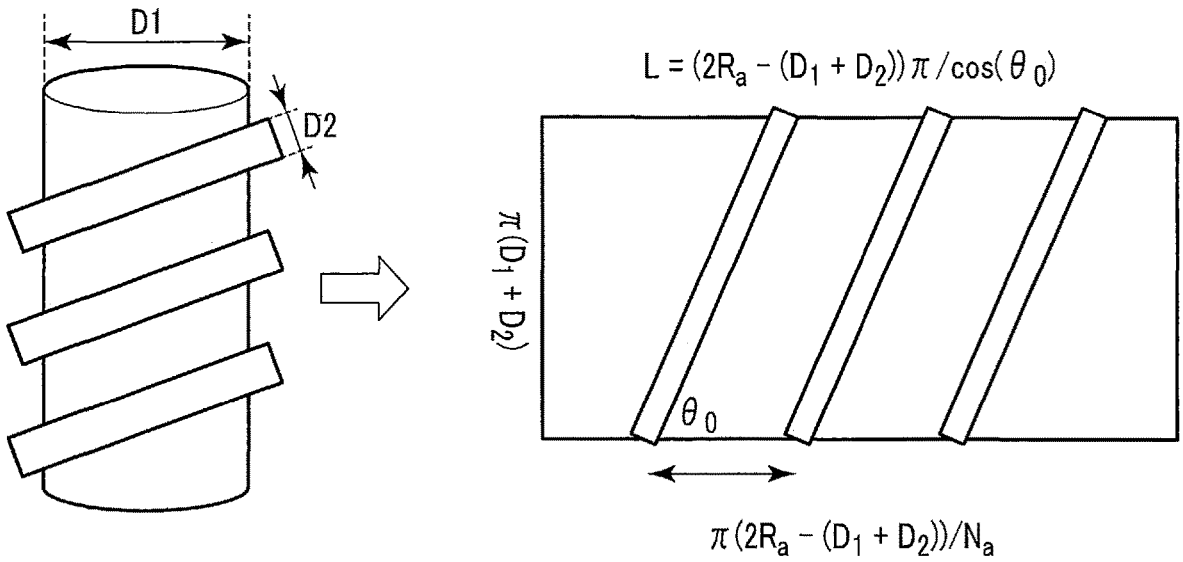
FIG. 10 is a view for explaining a method of designing a hollow tube shown in FIG. 1.

FIG. 10 shows the tube line length of a circular tube when a circular tube having a diameter $D_2$ is wound on a column having a diameter $D_1$. Letting $N_a$ be the winding number and $\theta_0$ be the winding angle, a tube line length L of the circular tube is given by:

$$L = \frac{N_a\pi(D_1 + D_2)}{\sin\theta_0} \tag{1}$$

Assuming that a circular tube having the diameter $D_2$ is wound on an annular member having an annular shape of a radius $R_a$ and a cross section of the diameter $D_1$, when the winding proceeds $$\frac{\pi(2R_a - (D_1 + D_2))}{N_a}$$

per one winding turn, the following relationship is obtained:

$$\tan\theta_0 = \frac{(D_1 + D_2)N_a}{2R_a - (D_1 + D_2)} \tag{2}$$

From this, the tube line length L is given by:

$$L = \frac{(2R_a - (D_1 + D_2))\pi}{\cos\theta_0} \tag{3}$$

Figure 11:
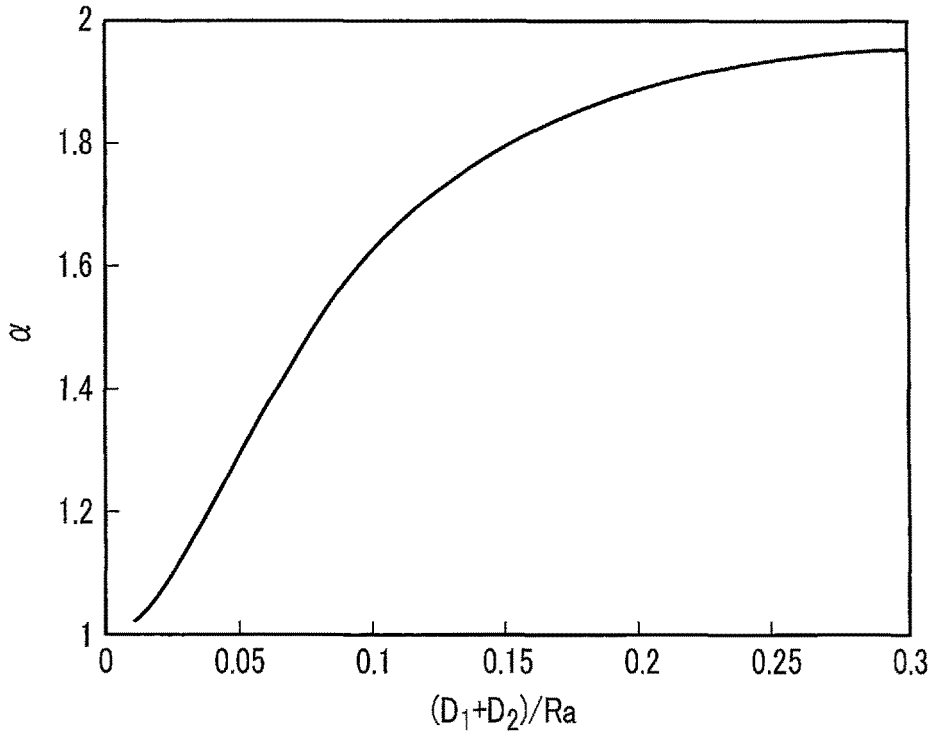
FIG. 11 is a graph for explaining the method of designing the hollow tube shown in FIG. 1.

The tube line length L needs to be corrected to wind the circular tube on the annular member, and a corrected tube line length $L_a$ is given by:

$$L_\alpha = L\times\alpha \tag{4}$$

where $\alpha$ is the correction coefficient and is a function of $(D_1+D_2)/R_a$, as shown in FIG. 11.

Procedures for designing the hollow tube 102 will be exemplified.

Step A: The tube line length $L_a$ is determined from a target frequency f and the order M of a target Lobe mode:

$$L_a = \frac{cM}{f}$$

where c is the speed of sound.

Step B: The radius $R_a$ of an annular ring and $(D_1+D_2)$ are determined.

For example, the radius $R_a$ is 1.1 times the radius of the fan 200. The radius $R_a$ is preferably closer to the radius of the fan 200. Although $(D_1+D_2)$ has no constraint, $(D_1+D_2)$ is set to, for example, 5% to 20% of the radius $R_a$ ($0.05<(D_1+D_2)/R_a<0.2$).

Step C: The winding angle $\theta_0$ is determined.

For example, the winding angle $\theta_0$ is determined by substituting $L_a$ determined in step A, and $R_a$ and $(D_1+D_2)$ determined in step B into expressions (3) and (4) above.

Step D: The winding number $N_a$ is determined.

For example, the winding number $N_a$ is determined by substituting $L_a$ determined in step A, $R_a$ and $(D_1+D_2)$ determined in step B, and the winding angle $\theta_0$ determined in step C into equation (2) above, and rounding off the obtained $N_a$.

If the winding number $N_a$ is smaller than 2M+1, the process returns to step B to change $(D_1+D_2)$. If the decimal part of the obtained $N_a$ ($N_a$ before round-off) is close to 0.5, the process returns to step B to change $(D_1+D_2)$.

Step E: The diameter $D_1$ of the annular member 110 and the diameter $D_2$ of the hollow tube 102 are determined.

For example, the diameters $D_1$ and $D_2$ are determined by distributing $(D_1+D_2)$ determined in step B. Since the sound wave sources are arranged inside the annular member 110, the diameter $D_1$ is set to a size enough to install a compact loudspeaker.

Accordingly, the diameter $D_2$ of the hollow tube 102, the diameter $D_1$ of the annular member 110, the radius $R_a$ of the annular ring, and the winding number $N_a$ are determined with respect to the target frequency f and the order M of the target Lobe mode.

To increase the degree of freedom of design, the hollow tube 102 is helically formed. For example, the tube line length $L_a$ of the hollow tube 102 can be adjusted by the winding number $N_a$.

[Design of Opening]

Next, a method of designing the openings 104 of the hollow tube 102 will be explained.

The internal space of each opening 104 in the hollow tube 102 and the dimensions of the opening 104 are optimized in accordance with the target frequency f, generating Helmholtz resonance and increasing the sound emitting efficiency. The opening 104 functions as a Helmholtz sound hole that amplifies and outputs a sound using the Helmholtz resonance. As a result, compact, lightweight loudspeakers can be used as the sound wave sources 106.

Typically, the openings 104 are formed to face the fan 200. The number of openings 104 is arbitrarily equal to or more than 2M+1, and the openings 104 are arranged symmetrically. More specifically, the openings 104 are arranged at equal angular intervals. For example, one opening 104 may be set every turn of the hollow tube 102. In this case, the volume V of the spatial region of one opening 104 can be given by:

$$V_h=(L_d/N_a)\times\pi(D_2/2)^2 \tag{5}$$

For example, when one opening 104 is set every two turns, the volume V of the spatial region of one opening 104 is double the volume given by expression (5) above. When one opening 104 is set every three turns, the volume V of the spatial region of one opening 104 is three times the volume given by expression (5) above.

A radius $a_h$ and height $t_h$ of the opening 104 are determined from a general Helmholtz resonance design given by:

$$f_h=\frac{a_h c}{2\pi}\sqrt{\frac{\pi}{V_h t'_h}}$$

where $t'_h$ is the height $t_h$ after end correction. The height $t_h$ coincides with the thickness (wall thickness) of the hollow tube 102. $f_h$ is set to or close to the target frequency f.

The sound emitting apparatus 100 is a discrete sound source corresponding to the number of openings 104. As the number of openings 104 is larger, the similarity between the characteristics of a sound emitted from the sound emitting apparatus 100 and the Lobe mode characteristics of the blade noise increases. The number of openings 104 depends on the winding number of the hollow tube 102 and can be increased by increasing the winding number.

[Arrangement of Sound Wave Sources]

Next, the arrangement of the sound wave sources 106 will be explained.

The arrangement method of the sound wave sources 106 includes, but is not limited to, an N=4M arrangement and an N=2M+a arrangement.

The N=4M arrangement is a method of arranging the sound wave sources 106 four times in number the order M of the Lobe mode. In the N=4M arrangement, the number of sound wave sources 106 is large, but phase shifts to be applied are 0°, 90°, 180°, and 270°, so the Lobe mode can be driven using one 90° phase shifter.

When the Lobe mode is the second-order Lobe mode, the arrangement shown in FIG. 2 is the N=4M arrangement. A phase shift regarding the sound wave source 106-*i* is $-M\phi_i$ where $\phi_i=2\pi(i-1)/N$. That is, a phase shift regarding each of the sound wave sources 106-1 and 106-5 is 0°, a phase shift regarding each of the sound wave sources 106-2 and 106-6 is −90°, a phase shift regarding each of the sound wave sources 106-3 and 106-7 is −180°, and a phase shift regarding each of the sound wave sources 106-4 and 106-8 is −270°.

Figure 12:
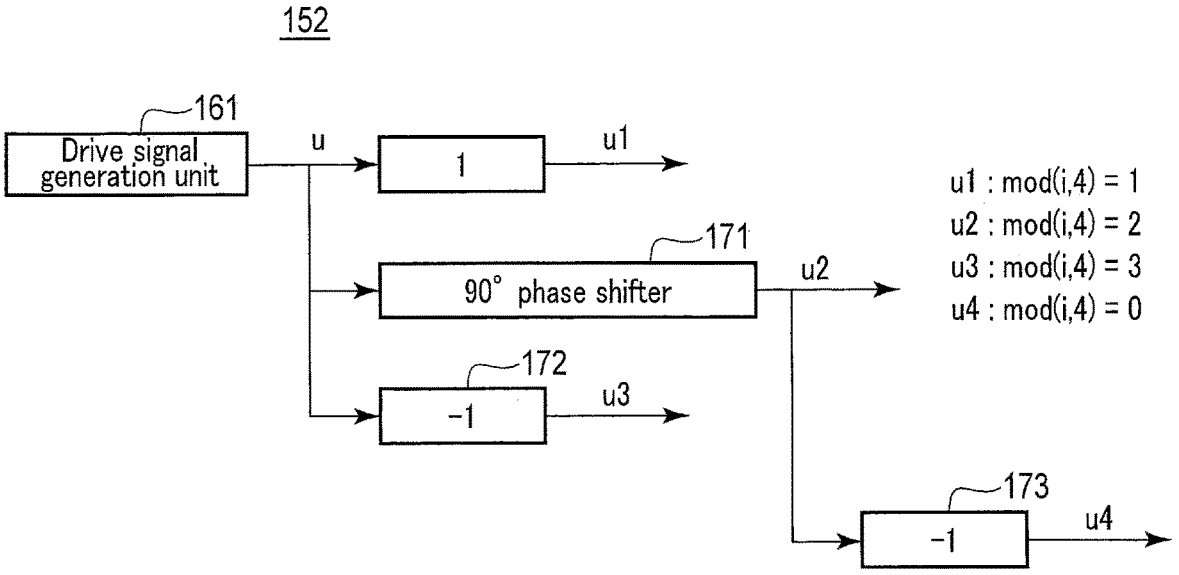
FIG. 12 is a block diagram showing a drive circuit that may be used for the N=4M arrangement according to an embodiment.

FIG. 12 schematically shows an example of the drive circuit 152 used for the N=4M arrangement. In the example shown in FIG. 12, the drive circuit 152 includes a drive signal generation unit 161, a 90° phase shifter 171, and inverting circuits 172 and 173. A drive signal u from the drive signal generation unit 161 is branched into three. A first branch drive signal u is output as it is as a drive signal u1. The drive signal u1 is sent to the sound wave source 106-*i*, where i satisfies mod(i, 4)=1. Specifically, the drive signal u1 is sent to the sound wave sources 106-1 and 106-5. A second branch drive signal u is supplied to the 90° phase shifter 171. The 90° phase shifter 171 applies a phase shift of −90° to the second branch drive signal to generate a drive signal u2. The drive signal u2 is branched into two. A first branch drive signal u2 is sent to the sound wave source 106-*i*, where i satisfies mod(i, 4)=2. Specifically, the first branch drive signal u2 is sent to the sound wave sources 106-2 and 106-6. A second branch drive signal u2 is supplied to the inverting circuit 173. The inverting circuit 173 inverts the second branch drive signal u2 to generate a drive signal u4. The drive signal u4 is sent to the sound wave source 106-*i*, where i satisfies mod(i, 4)=4. Specifically, the drive signal u4 is sent to the sound wave sources 106-4 and 106-8. A third branch drive signal u is supplied to the inverting circuit 172. The inverting circuit 172 inverts the third branch drive signal u to generate a drive signal u3. The drive signal u3 is sent to the sound wave source 106-*i*, where i satisfies mod(i, 4)=3. Specifically, the drive signal u3 is sent to the sound wave sources 106-3 and 106-7.

In the N=4M arrangement, the Lobe mode can be excited using one 90° phase shifter.

The N=2M+α arrangement is a method of arranging the sound wave sources 106 in number obtained by adding a to double the order M of the Lobe mode, where a is an integer of 1 or more. From the viewpoint of spatial aliasing, a is desirably equal to or larger than 3. In the N=2M+α arrangement, when N is an even number other than 3M, N/2−1 phase shifters are required. For example, when the Lobe mode is the seventh-order Lobe mode and 16 sound wave sources 106 are arranged in the hollow tube 102, seven phase shifters are required. When N is 3M, two phase shifters are sufficient. The value N is determined in consideration of a balance between the number of phase shifters and the number of sound wave sources 106.

Figure 13A:
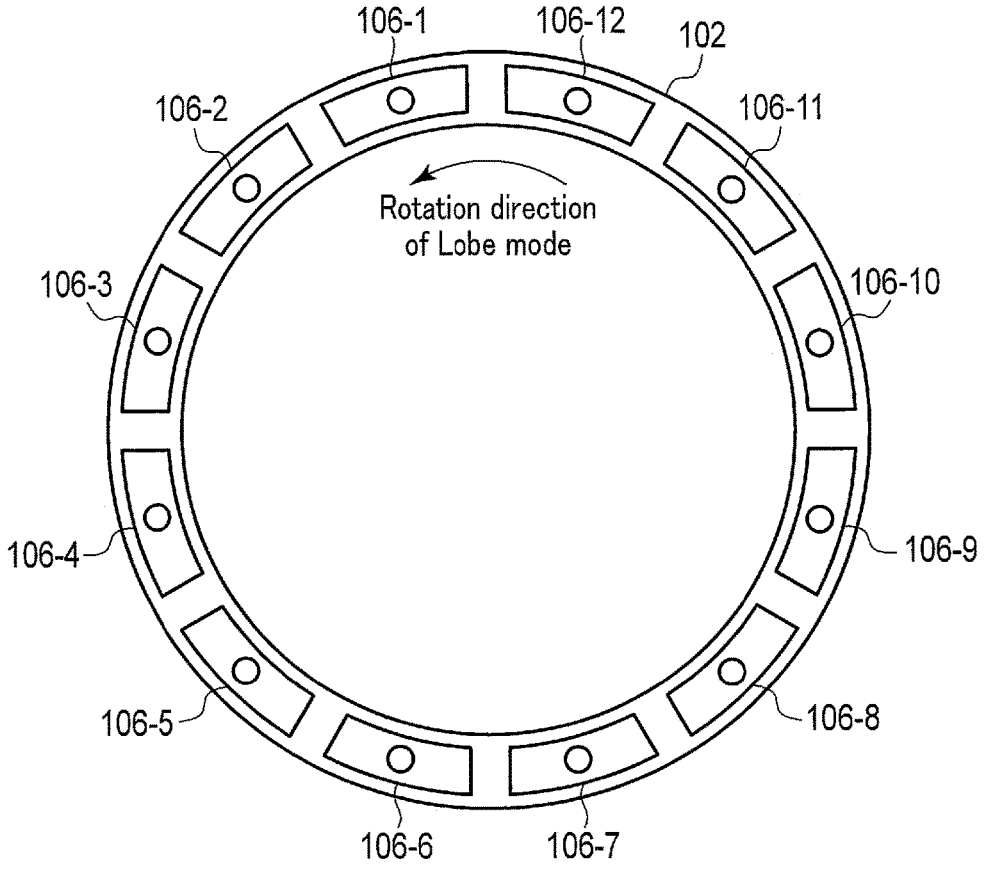
FIG. 13A is a view showing the N=2M+a arrangement according to an embodiment.

FIG. 13A schematically shows an example of the N=2M+α arrangement. In the example shown in FIG. 13A, the Lobe mode is the fourth-order Lobe mode, and 12 sound wave sources 106-1 to 106-12 are arranged in the hollow tube 102 at intervals of 30°. The arrangement shown in FIG. 13A satisfies N=3M. A phase shift regarding the sound wave source 106-*i* is $-M\phi_i$, where $\phi_i=2\pi(i-1)/N$. That is, a phase shift regarding each of the sound wave sources 106-1, 106-4, 106-7, and 106-10 is 0°, a phase shift regarding each of the sound wave sources 106-2, 106-5, 106-8, and 106-11 is −120°, and a phase shift regarding each of the sound wave sources 106-3, 106-6, 106-9, and 106-12 is −240°.

Figure 13B:
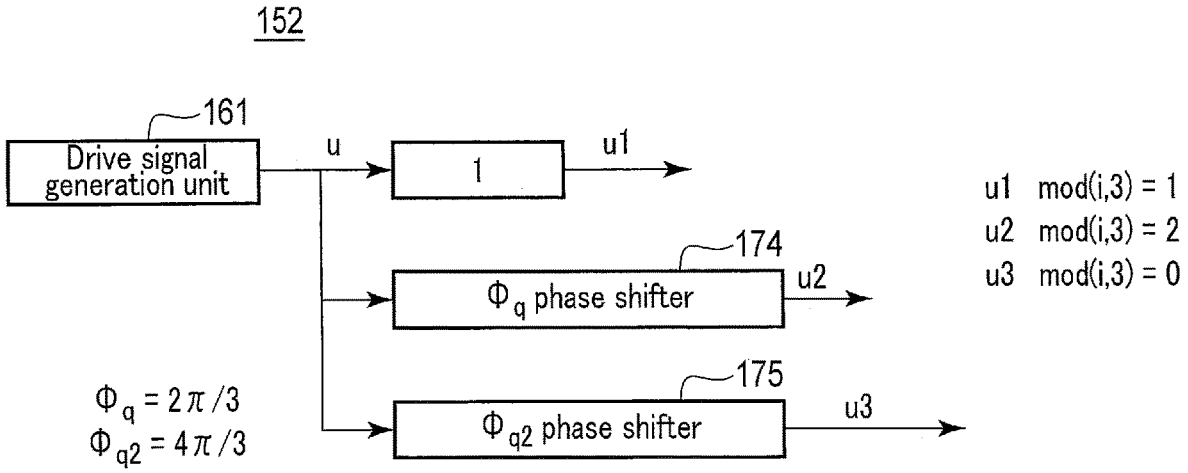
FIG. 13B is a block diagram showing a drive circuit that may be used for the arrangement shown in FIG. 13A.

FIG. 13B schematically shows an example of the drive circuit 152 used in the arrangement shown in FIG. 13A. As shown in FIG. 13B, the drive circuit 152 includes the drive signal generation unit 161, a 120° phase shifter 174, and a 240° phase shifter 175. A drive signal u from the drive signal generation unit 161 is branched into three. A first branch drive signal u is output as it is as a drive signal u1. The drive signal u1 is sent to the sound wave sources 106-1, 106-4, 106-7, and 106-10. A second branch drive signal u is supplied to the 120° phase shifter 174. The 120° phase shifter 174 applies a phase shift of −120° to the second branch drive signal u to generate a drive signal u2. The drive signal u2 is sent to the sound wave sources 106-2, 106-5, 106-8, and 106-11. A third branch drive signal u is supplied to the 240° phase shifter 175. The 240° phase shifter 175 applies a phase shift of −240° to the third branch drive signal u to generate a drive signal u3. The drive signal u3 is sent to the sound wave sources 106-3, 106-6, 106-9, and 106-12.

In the N=3M arrangement, the Lobe mode can be excited using two phase shifters.

As M increases, the number of sound wave sources 106 increases. In the N=3M arrangement, the sound wave sources 106-1 and 106-4 shown in FIG. 13A emit the same sound. The sound wave sources 106-1 and 106-4 can be implemented by one loudspeaker 109.

Figure 14:
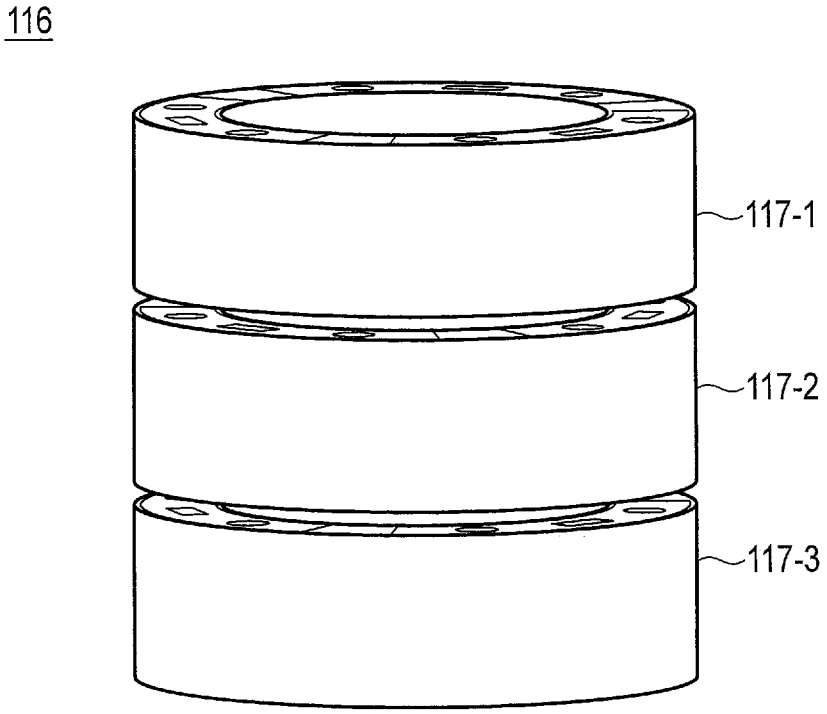
FIG. 14 is a perspective view showing a sound wave source assembly according to an embodiment.

FIG. 14 schematically shows a sound wave source assembly 116 that may be used for the N=3M arrangement according to the embodiment. As shown in FIG. 14, the sound wave source assembly 116 has a three-layered structure in which layers 117-1, 117-2, and 117-3 are stacked. The layer 117-1 includes the sound wave sources 106-1, 106-4, 106-7, and 106-10 shown in FIG. 13A, the layer 117-2 includes the sound wave sources 106-2, 106-5, 106-8, and 106-11 shown in FIG. 13A, and the layer 117-3 includes the sound wave sources 106-3, 106-6, 106-9, and 106-12 shown in FIG. 13A.

Figure 15:
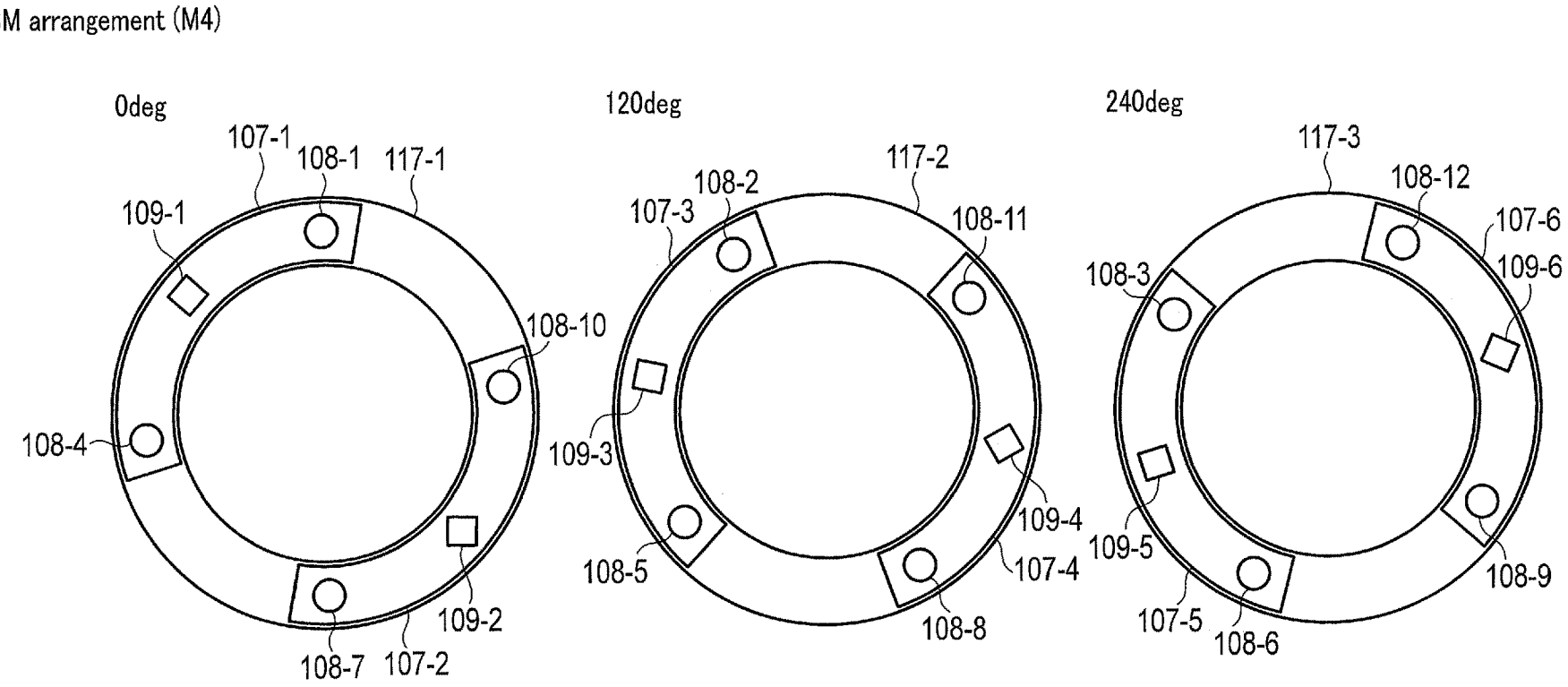
FIG. 15 is an exploded view showing the sound wave source assembly according to an embodiment.

FIG. 15 shows a state in which the sound wave source assembly 116 shown in FIG. 14 is disassembled. As shown in FIG. 15, the layer 117-1 includes enclosure parts 107-1 and 107-2, connecting tubes 108-1, 108-4, 108-7, and 108-10, and loudspeakers 109-1 and 109-2.

The connecting tubes 108-1 and 108-4 are provided at the enclosure part 107-1, and the loudspeaker 109-1 is arranged in the enclosure part 107-1. The distance between the loudspeaker 109-1 and the connecting tube 108-1 equals that between the loudspeaker 109-1 and the connecting tube 108-4. The sound wave source 106-1 shown in FIG. 13A is implemented by the enclosure part 107-1, the connecting tube 108-1, and the loudspeaker 109-1. The sound wave source 106-4 shown in FIG. 13A is implemented by the enclosure part 107-1, the connecting tube 108-4, and the loudspeaker 109-1. The sound wave sources 106-1 and 106-4 share the enclosure part 107-1 and the loudspeaker 109-1.

The connecting tubes 108-7 and 108-10 are provided at the enclosure part 107-2, and the loudspeaker 109-2 is arranged in the enclosure part 107-2. The distance between the loudspeaker 109-2 and the connecting tube 108-7 equals that between the loudspeaker 109-2 and the connecting tube 108-10. The sound wave source 106-4 shown in FIG. 13A is implemented by the enclosure part 107-2, the connecting tube 108-7, and the loudspeaker 109-2. The sound wave source 106-10 shown in FIG. 13A is implemented by the enclosure part 107-2, the connecting tube 108-10, and the loudspeaker 109-2. The sound wave sources 106-4 and 106-10 share the enclosure part 107-2 and the loudspeaker 109-2.

The layer 117-2 includes enclosure parts 107-3 and 107-4, connecting tubes 108-2, 108-5, 108-8, and 108-11, and loudspeakers 109-3 and 109-4.

The connecting tubes 108-2 and 108-5 are provided at the enclosure part 107-3, and the loudspeaker 109-3 is arranged in the enclosure part 107-3. The sound wave source 106-2 shown in FIG. 13A is implemented by the enclosure part 107-3, the connecting tube 108-2, and the loudspeaker 109-3. The sound wave source 106-5 shown in FIG. 13A is implemented by the enclosure part 107-3, the connecting tube 108-5, and the loudspeaker 109-3. The sound wave sources 106-2 and 106-5 share the enclosure part 107-3 and the loudspeaker 109-3.

The connecting tubes 108-8 and 108-11 are provided at the enclosure part 107-4, and the loudspeaker 109-4, is arranged in the enclosure part 107-4. The sound wave source 106-8 shown in FIG. 13A is implemented by the enclosure part 107-4, the connecting tube 108-8, and the loudspeaker 109-4. The sound wave source 106-11 shown in FIG. 13A is implemented by the enclosure part 107-4, the connecting tube 108-11, and the loudspeaker 109-4. The sound wave sources 106-8 and 106-11 share the enclosure part 107-4 and the loudspeaker 109-4.

The layer 117-3 includes enclosure parts 107-5 and 107-6, connecting tubes 108-3, 108-6, 108-9, and 108-12, and loudspeakers 109-5 and 109-6.

The connecting tubes 108-3 and 108-6 are provided at the enclosure part 107-5, and the loudspeaker 109-5 is arranged in the enclosure part 107-5. The sound wave source 106-3 shown in FIG. 13A is implemented by the enclosure part 107-5, the connecting tube 108-3, and the loudspeaker 109-5. The sound wave source 106-6 shown in FIG. 13A is implemented by the enclosure part 107-5, the connecting tube 108-6, and the loudspeaker 109-5. The sound wave sources 106-3 and 106-6 share the enclosure part 107-5 and the loudspeaker 109-5.

The connecting tubes 108-9 and 108-12 are provided at the enclosure part 107-6, and the loudspeaker 109-6 is arranged in the enclosure part 107-6. The sound wave source 106-9 shown in FIG. 13A is implemented by the enclosure part 107-6, the connecting tube 108-9, and the loudspeaker 109-6. The sound wave source 106-12 shown in FIG. 13A is implemented by the enclosure part 107-6, the connecting tube 108-12, and the loudspeaker 109-6. The sound wave sources 106-9 and 106-12 share the enclosure part 107-6 and the loudspeaker 109-6.

In this manner, the 12 sound wave sources 106-1 to 106-12 are implemented by the six loudspeakers 109-1 to 109-6.

Figure 16:
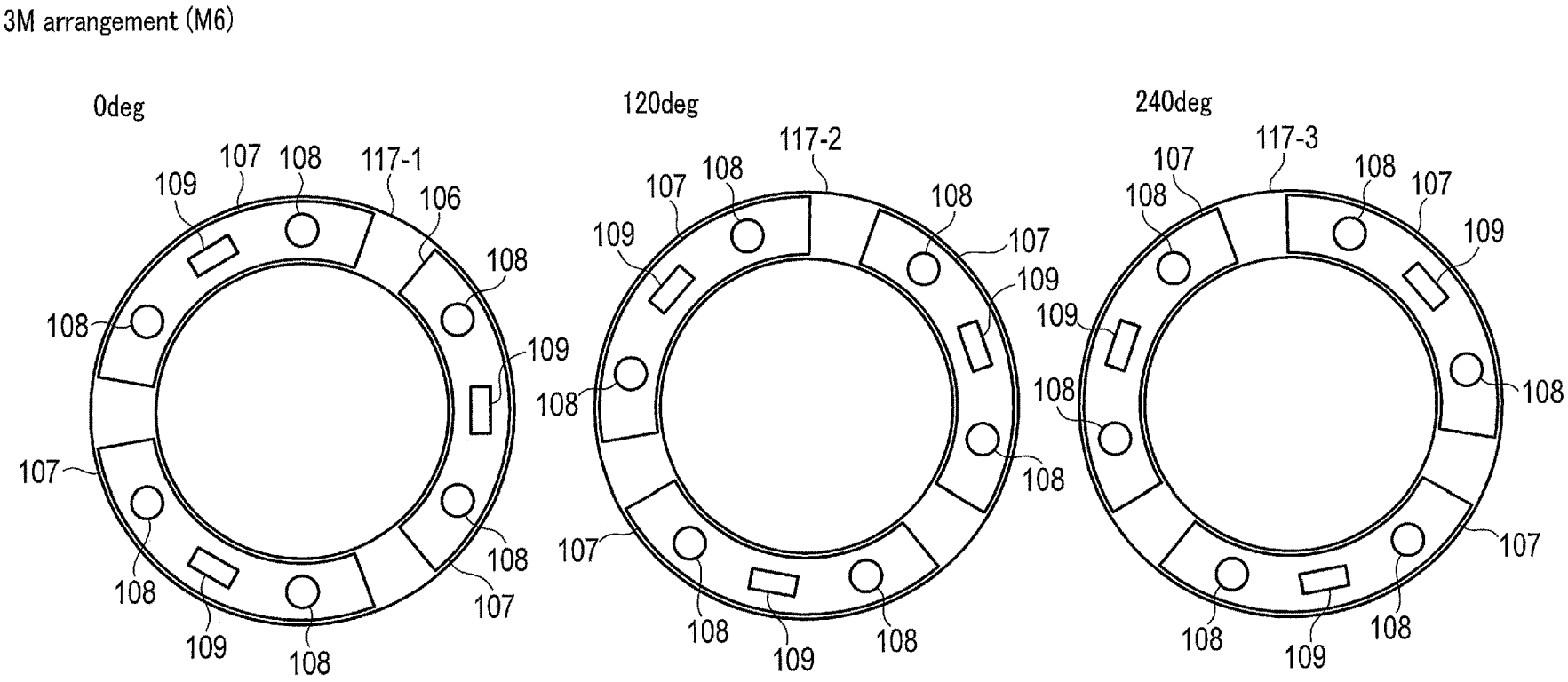
FIG. 16 is an exploded view showing the sound wave source assembly according to an embodiment.

For M=6 and N=18, 18 sound wave sources 106 can be implemented by nine loudspeakers 109, as shown in FIG. 16. For M=8 and N=24, 24 sound wave sources 106 can be implemented by 12 loudspeakers 109, as shown in FIG. 17.

Figure 17:
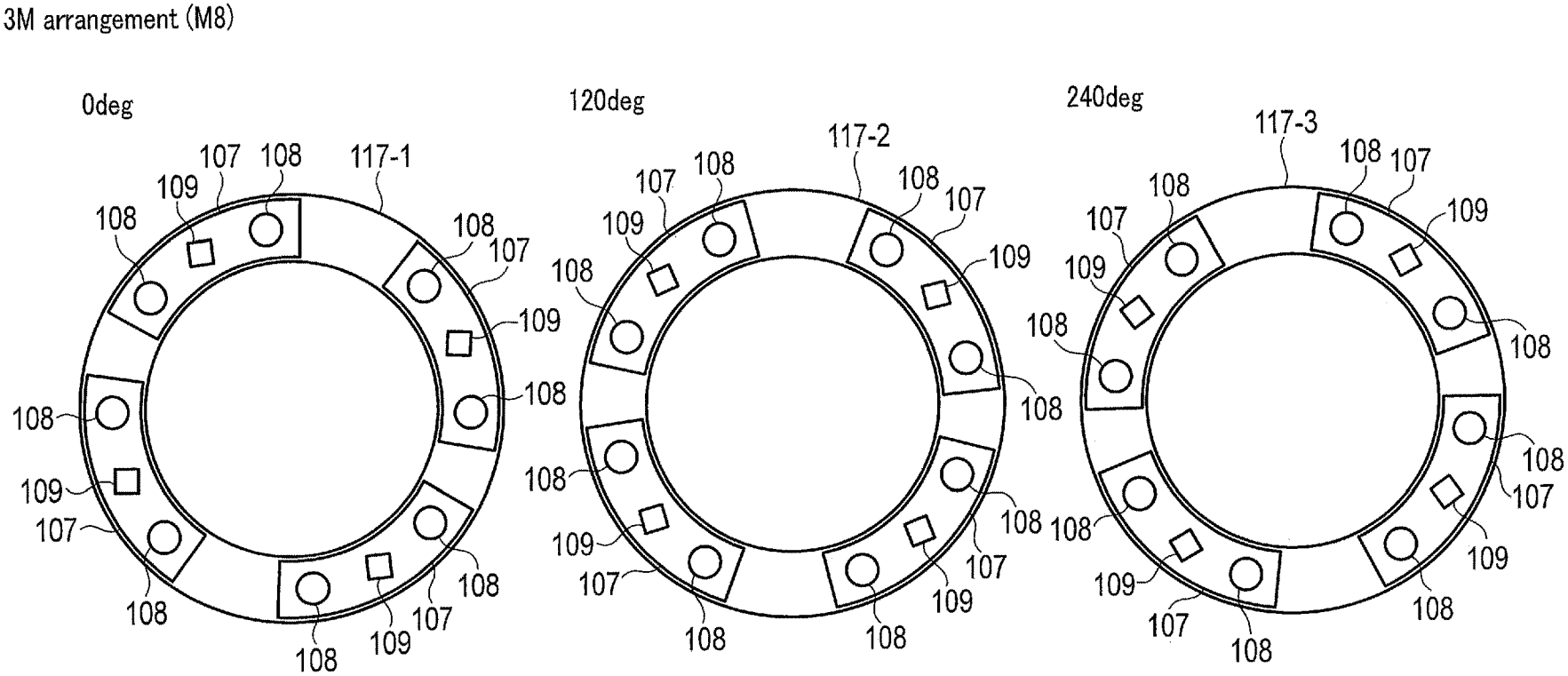
FIG. 17 is an exploded view showing the sound wave source assembly according to an embodiment.
Figure 18:
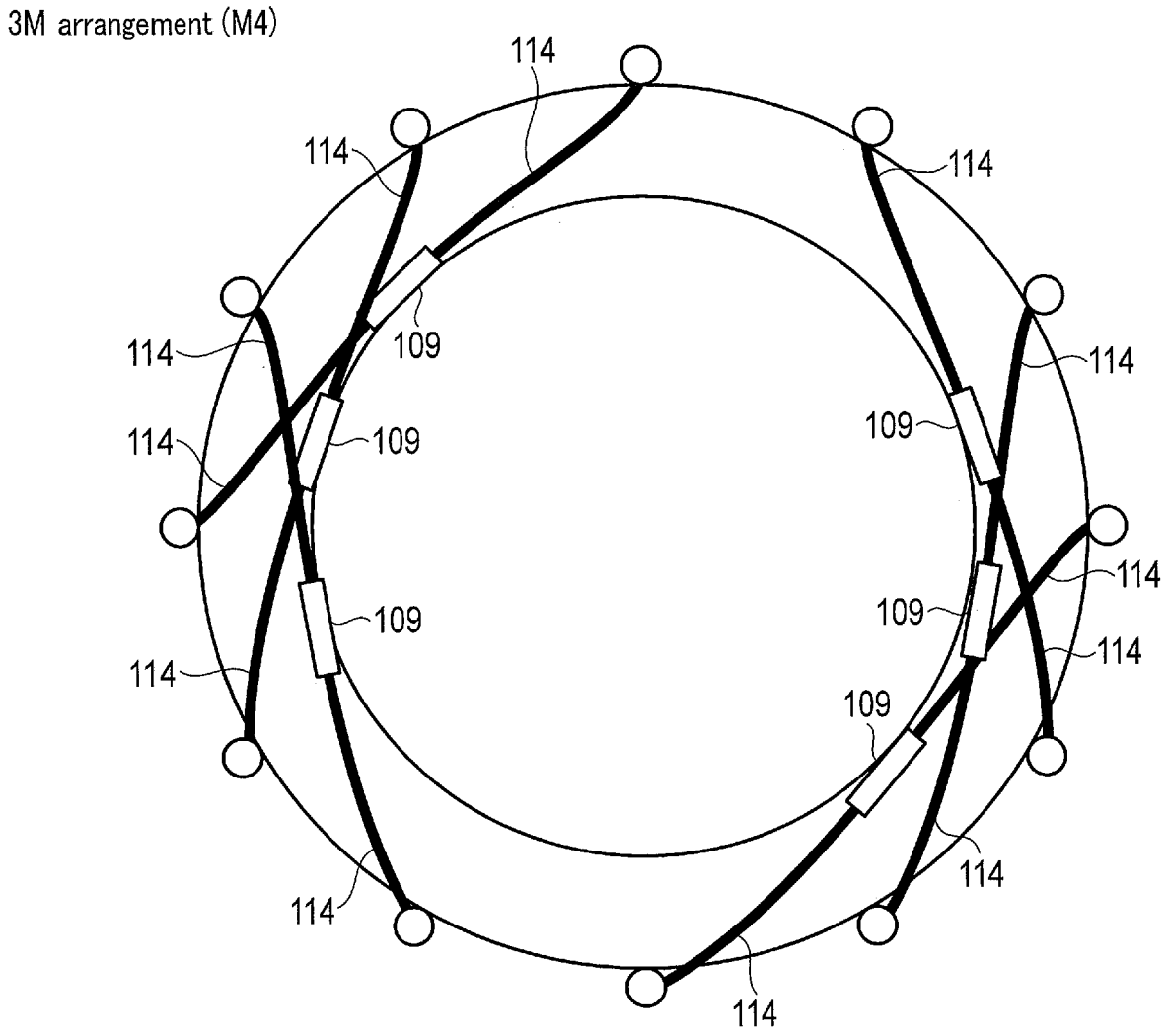
FIG. 18 is a view showing the sound wave source assembly according to an embodiment.

The arrangements shown in FIGS. 15, 16, and 17 are merely examples. As shown in FIG. 18, a pair of sound wave sources 106 may be implemented by the loudspeaker 109 and two tubes 114. The two tubes 114 have the same length.

[Double Helical Structure]

In the example shown in FIG. 1, the sound emitting apparatus 100 includes one hollow tube 102. The sound emitting apparatus 100 may include two hollow tubes 102.

Figure 19:
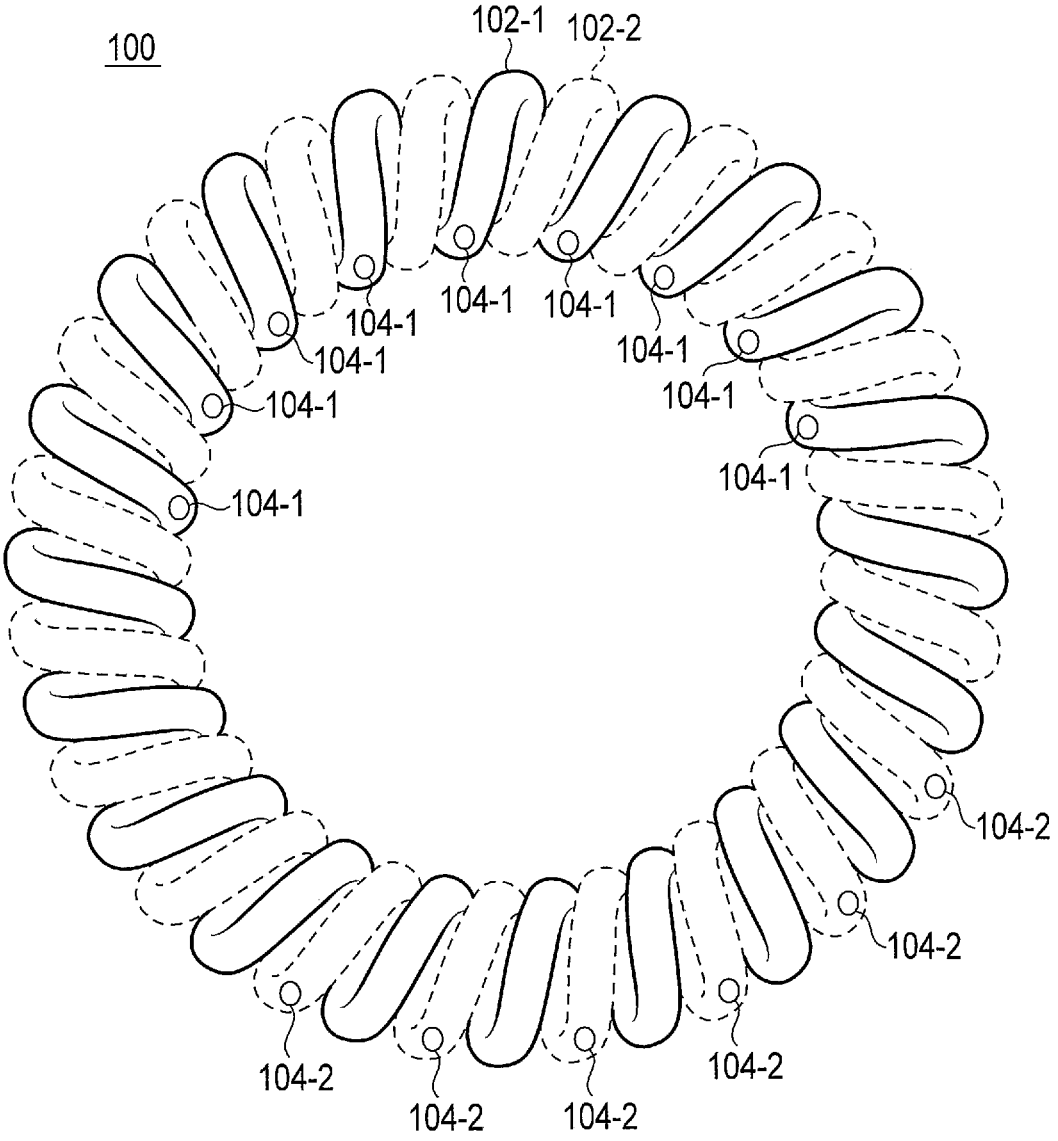
FIG. 19 is a perspective view showing the sound emitting apparatus according to an embodiment.

FIG. 19 schematically shows the sound emitting apparatus 100 according to an embodiment. As shown in FIG. 19, the sound emitting apparatus 100 includes hollow tubes 102-1 and 102-2, and the sound wave sources 106 (not shown in FIG. 19). In FIG. 19, to discriminate the hollow tubes 102-1 and 102-2, the hollow tube 102-1 is indicated by a solid line, and the hollow tube 102-2 is indicated by a broken line.

The hollow tubes 102-1 and 102-2 have a double helical structure. The hollow tube 102-1 has a plurality of openings 104-1, and the openings 104-1 are formed on the inner side of the hollow tube 102-1. The hollow tube 102-2 has a plurality of openings 104-2, and the openings 104-2 are formed on the outer side of the hollow tube 102-2.

The sound wave sources 106 are provided for each of the hollow tubes 102-1 and 102-2. In the case of a dipole sound source, that is, a case in which the sound wave output (inward sound wave output) of the hollow tube 102-1 coincides with the sound wave output (outward sound wave output) of the hollow tube 102-2, the hollow tubes 102-1 and 102-2 may share the sound wave sources 106.

Since the hollow tubes 102-1 and 102-2 are provided in the double helical structure, the number of rotational sound sources can be increased without increasing the space.

[Position of Opening]

In the example shown in FIG. 1, the openings 104 are formed toward the fan 200 (on the inner side of the hollow tube 102-1). The openings 104 may be formed in another direction.

Figure 20:
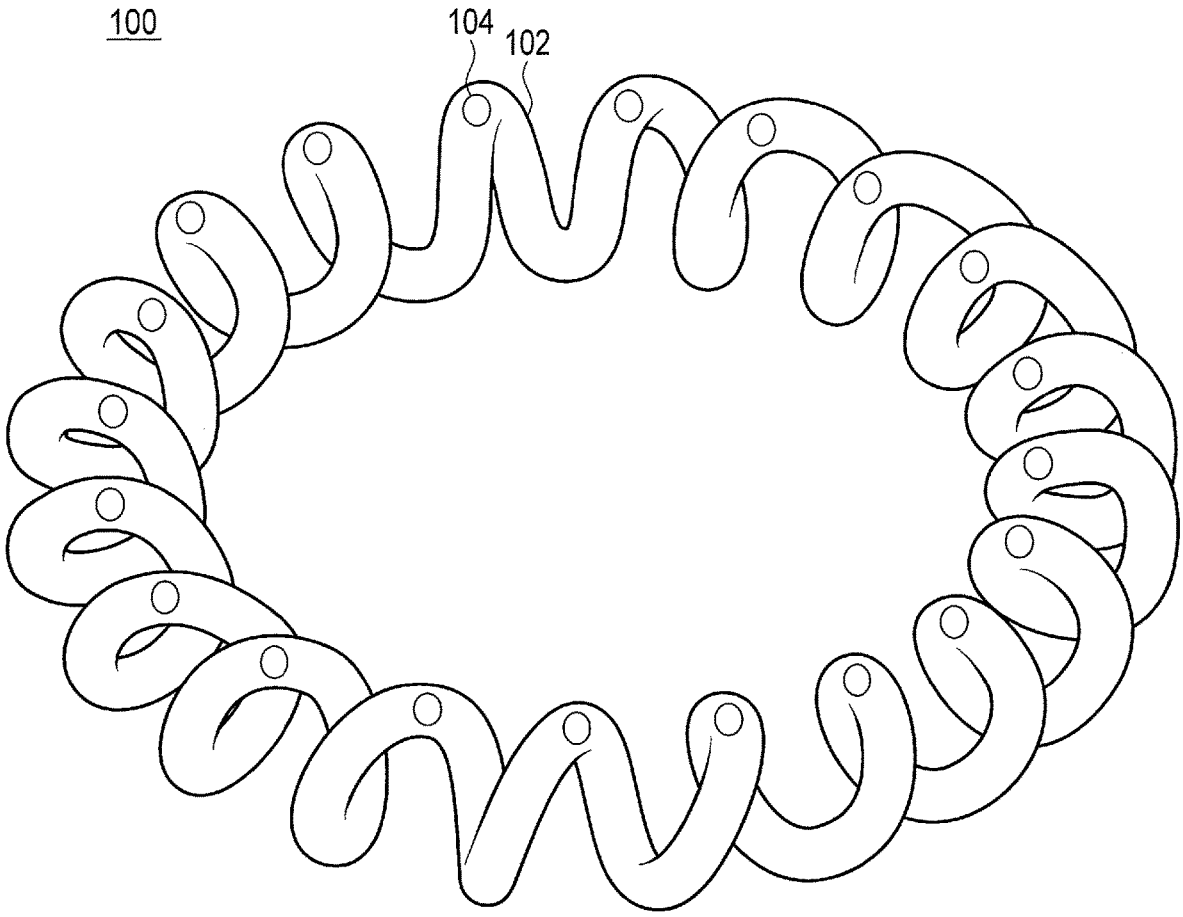
FIG. 20 is a plan view showing the sound emitting apparatus according to an embodiment.

FIG. 20 schematically shows the sound emitting apparatus 100 according to an embodiment. As shown in FIG. 20, the sound emitting apparatus 100 includes the hollow tube 102 and the sound wave sources 106 (not shown in FIG. 20). The hollow tube 102 has a plurality of openings 104, and the openings 104 are formed on the upper side of the hollow tube 102.

Figure 21A:
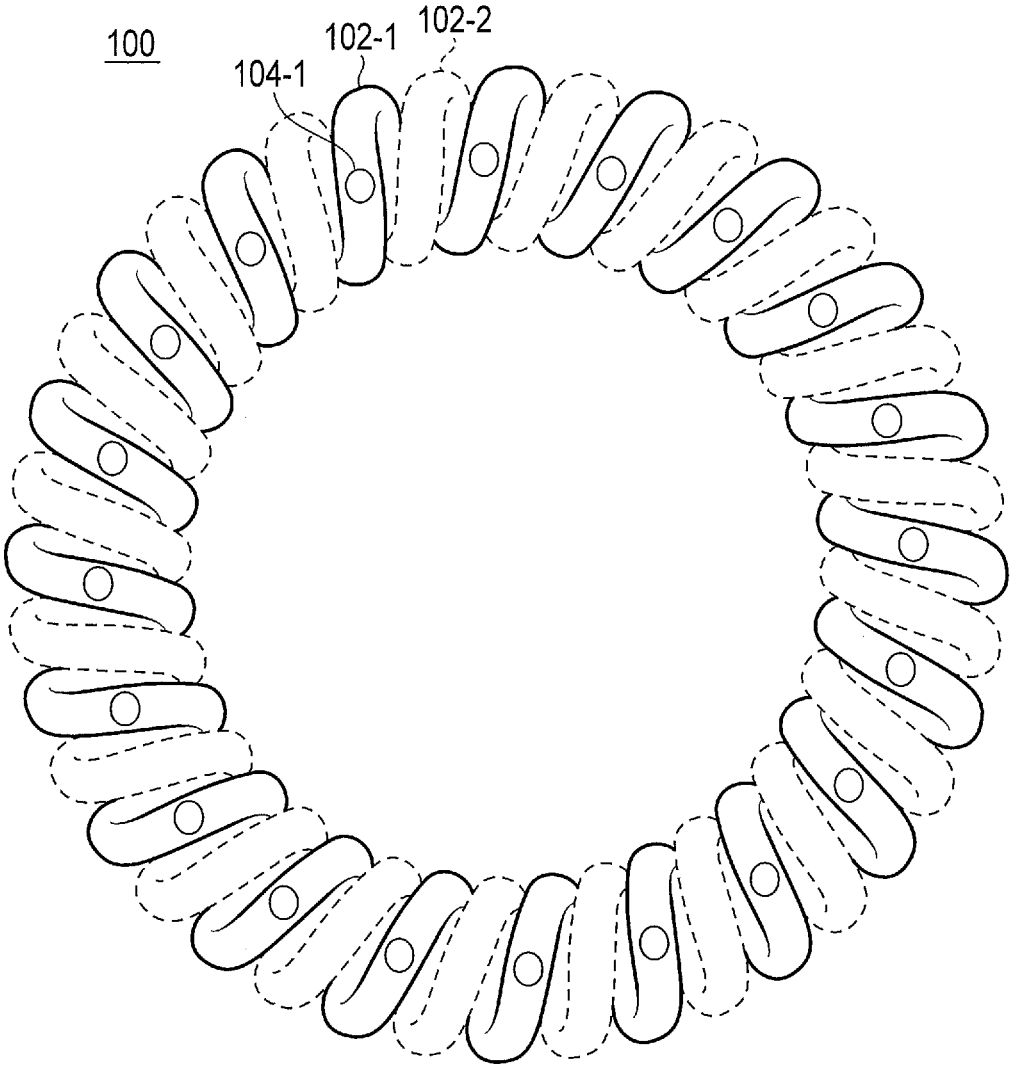
FIG. 21A is a top view showing the sound emitting apparatus according to an embodiment.
Figure 21B:
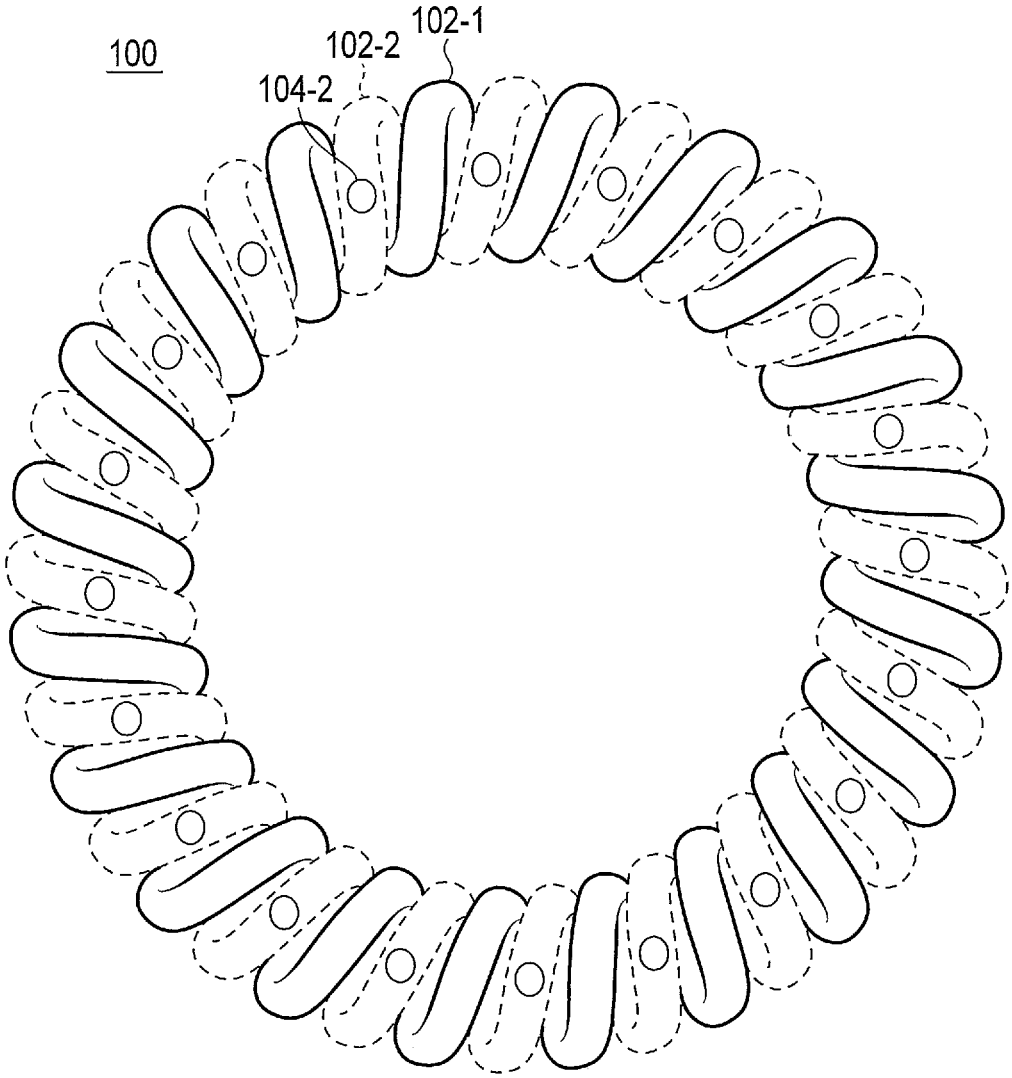
FIG. 21B is a bottom view showing the sound emitting apparatus according to an embodiment.

FIGS. 21A and 212 are top and bottom views schematically showing the sound emitting apparatus 100 according to an embodiment. As shown in FIGS. 21A and 21B, the sound emitting apparatus 100 includes the hollow tubes 102-1 and 102-2, and the sound wave sources 106 (not shown in FIGS. 21A and 21B). In FIGS. 21A and 21B, the hollow tube 102-1 is indicated by a solid line, and the hollow tube 102-2 is indicated by a broken line. The hollow tubes 102-1 and 102-2 have a double helical structure. The hollow tube 102-1 has a plurality of openings 104-1, and the openings 104-1 are formed on the upper side of the hollow tube 102-1, as shown in FIG. 21A. The hollow tube 102-2 has a plurality of openings 104-2, and the openings 104-2 are formed on the lower side of the hollow tube 102-2, as shown in FIG. 21B.

[Lobe Mode Separation and Sound Collection]

A method of separating the Lobe mode and collecting a sound will be explained.

Figure 22:
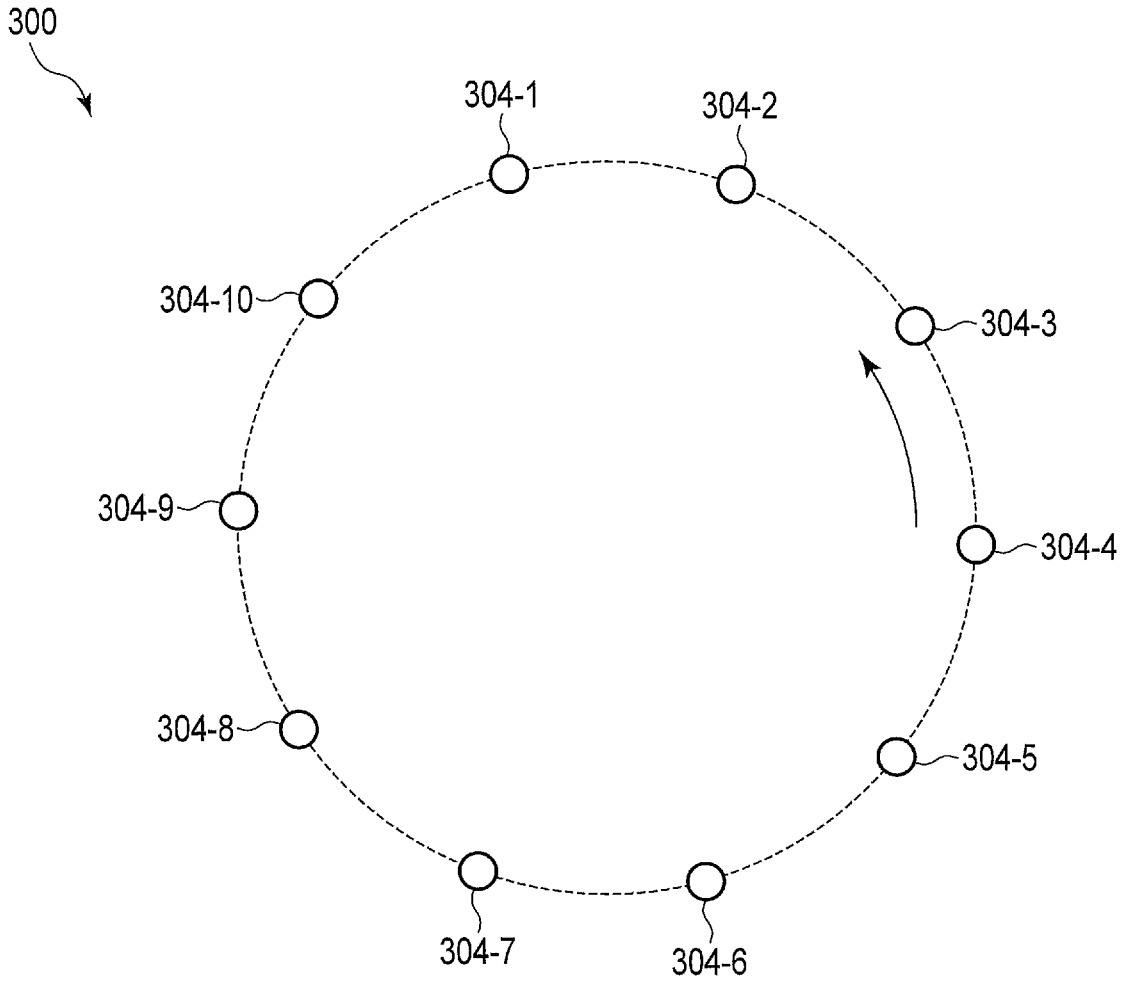
FIG. 22 is a plan view showing a sound collection device according to an embodiment.

FIG. 22 schematically shows an example of the arrangement of a sound collection device 300 according to an embodiment. As shown in FIG. 22, the sound collection device 300 includes Nb microphones 304 each corresponding to a transducer that converts a sound into an electric signal. The microphones 304 are arranged at predetermined angular intervals. In the example shown in FIG. 22, the sound collection device 300 includes 10 microphones 304-1 to 304-10, and the microphones 304-1 to 304-10 are arranged at angular intervals of 36°. The branch numbers are sequentially assigned in a direction opposite to the rotation direction of the Lobe mode indicated by the arrow.

Figure 23:
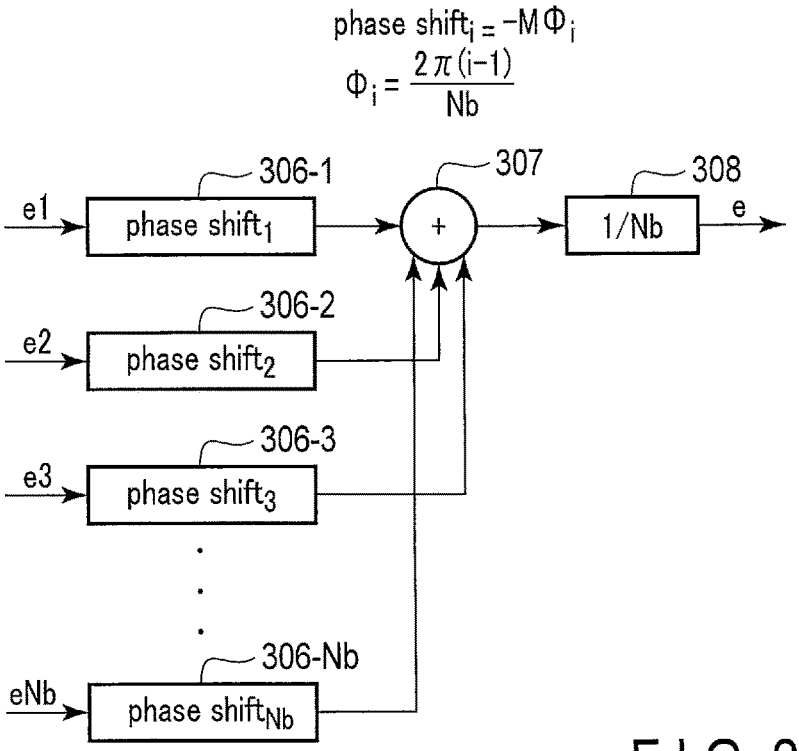
FIG. 23 is a block diagram showing an example of a processing circuit included in the sound collection device shown in FIG. 22.

FIG. 23 schematically shows an example of a processing circuit included in the sound collection device 300. In the example shown in FIG. 23, the processing circuit is configured to extract a signal related to the Mth-order Lobe mode, and includes Nb phase shifters 306-1 to 306-Nb, an adder 307, and an amplifier 308 having a gain of 1/Nb, where Nb is the number of microphones 304. In FIG. 23, a signal ei indicates an output signal of the microphone 304-*i*. The phase shifter 306-*i* applies the phase shift $-M\phi_i$ to the signal ei, where $\phi_i=2\pi(i-1)/Nb$. The output signals of the phase shifters 306-1 to 306-Nb are added by the adder 307, and the output signal of the adder 307 is amplified (reduced to 1/Nb) by the amplifier 308. An output signal e of the amplifier 308 is a signal related to the Mth-order Lobe mode.

Figure 24:
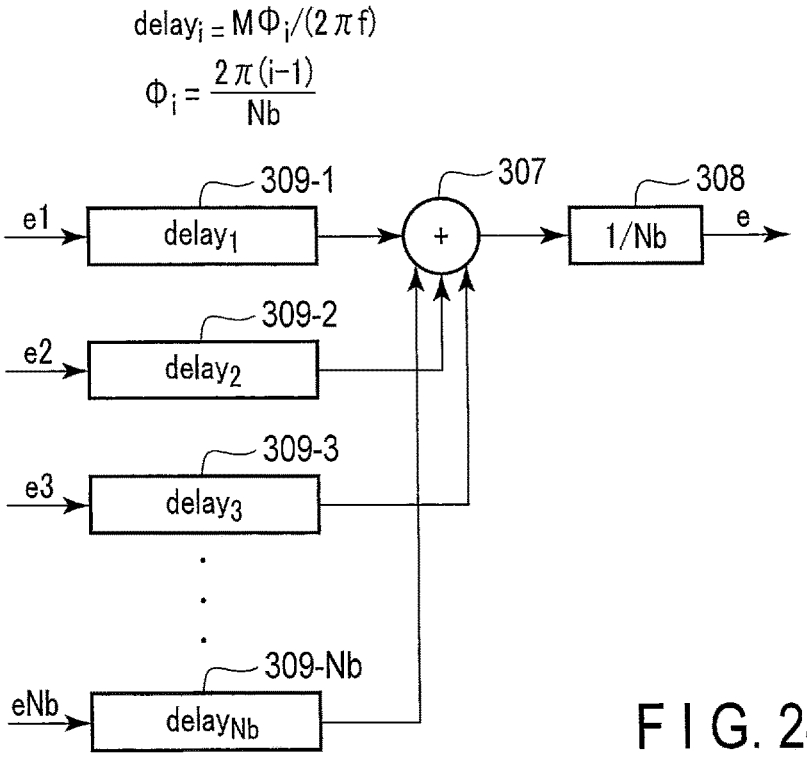
FIG. 24 is a block diagram showing another example of the processing circuit included in the sound collection device shown in FIG. 22.

FIG. 24 schematically shows another example of the processing circuit included in the sound collection device 300. In the example shown in FIG. 24, the processing circuit is configured to extract a signal related to the Mth-order Lobe mode, and includes Nb delay units 309-1 to 309-Nb, the adder 307, and the amplifier 308 having a gain of 1/Nb. The delay unit 309-*i* delays the signal ei by a time $M\phi_i/2\pi f$, where $\phi_i=2\pi(i-1)/Nb$. The output signals of the delay units 309-1 to 309-Nb are added by the adder 307, and the output signal of the adder 307 is amplified (reduced to 1/Nb) by the amplifier 308. The output signal e of the amplifier 308 is a signal related to the Mth-order Lobe mode.

By preparing a plurality of processing circuits as shown in FIG. 23 or 24, a plurality of Lobe modes can be separated.

When extracting a signal related to the Mth-order Lobe mode, the number of phase shifters can be reduced using 3M or 4M microphones 304. For example, a processing circuit including two phase shifters can extract a signal related to the Mth-order Lobe mode from a signal obtained by the 3M microphones 304 arranged at regular intervals. Also, a processing circuit including one phase shifter can extract a signal related to the Mth-order Lobe mode from a signal obtained by the 4M microphones 304 arranged at regular intervals.

[Blade Noise Reduction]

Next, an example in which the sound emitting apparatus according to the embodiment is applied to blade noise reduction will be described.

Figure 25:
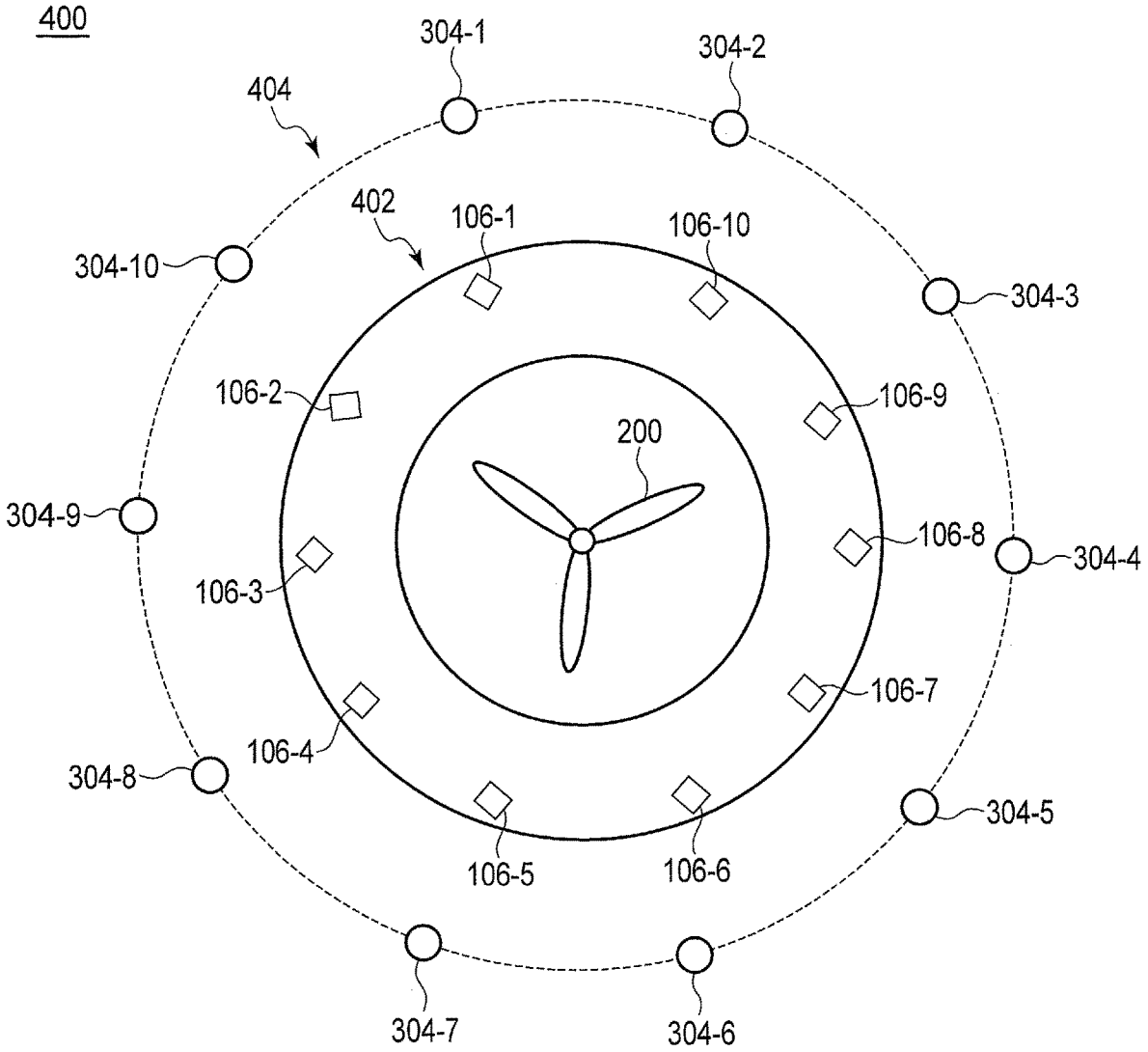
FIG. 25 is a plan view showing a blade noise reduction apparatus according to an embodiment.

FIG. 25 schematically shows the outer appearance of a blade noise reduction apparatus 400 according to an embodiment. As shown in FIG. 25, the blade noise reduction apparatus 400 includes a sound emitting apparatus 402 and a sound collection device 404. The sound emitting apparatus 402 may be the sound emitting apparatus 100 shown in FIGS. 1 and 2. The sound emitting apparatus 402 includes a hollow tube 102 and sound wave sources 106. The sound collection device 404 may be the sound collection device 300 shown in FIG. 22. The sound collection device 404 includes microphones 304.

A fan 200 corresponding to a noise source is arranged inside the sound emitting apparatus 402, and the microphones 304 are arranged outside the sound emitting apparatus 402. When the noise source is only the rotational blades and the influence of environmental reflection is low, one microphone is sufficient. In other cases, it is desirable to use 2M+1 or more microphones.

Figure 26:
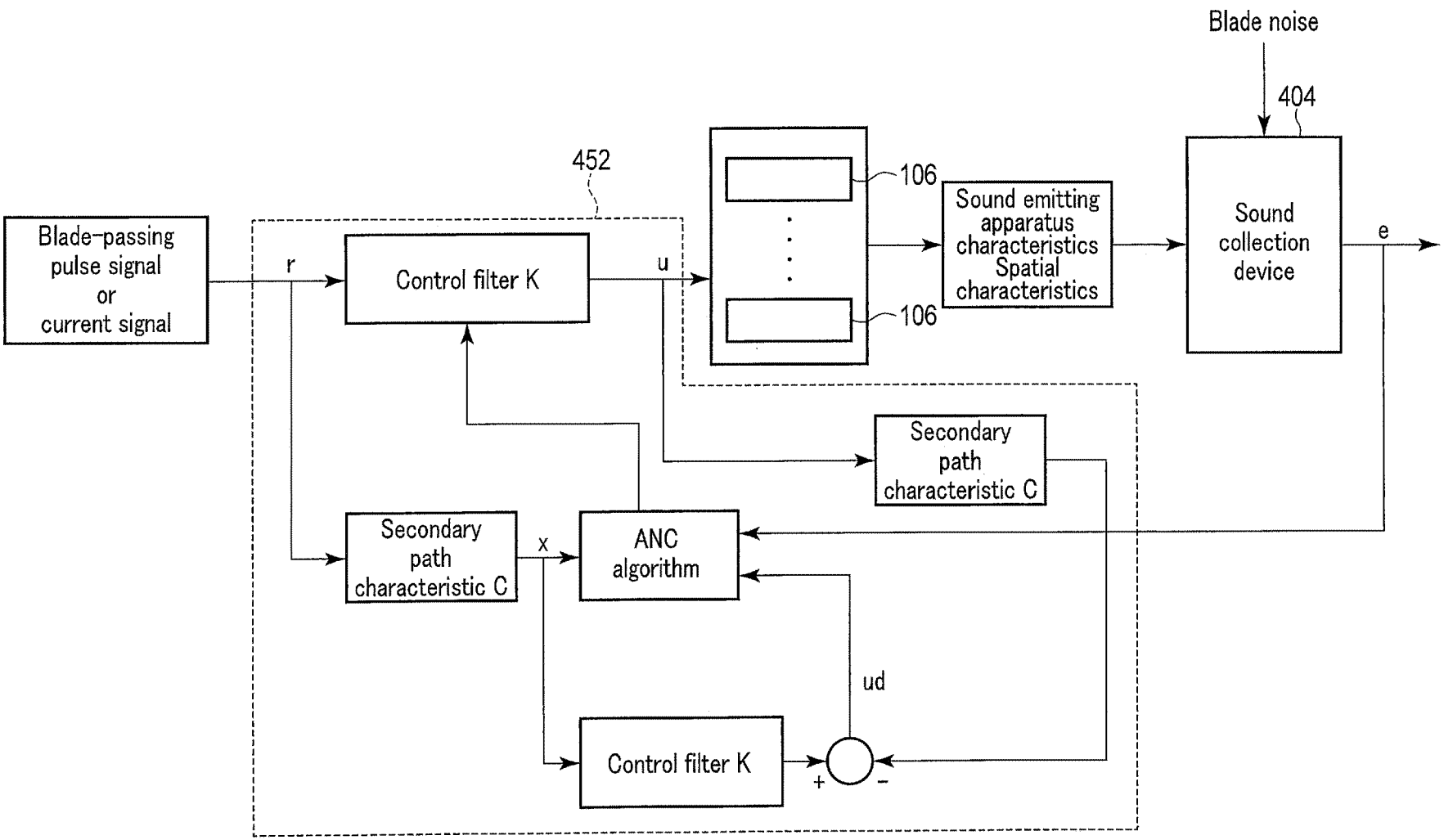
FIG. 26 is a block diagram showing an example of a control circuit included in the blade noise reduction apparatus shown in FIG. 25.

FIG. 26 schematically shows an example of a control circuit of the blade noise reduction apparatus 400. In the example shown in FIG. 26, the control circuit is based on feedforward active noise control (ANC). In the feedforward ANC, a blade-passing pulse signal or a blade drive current signal is used as a reference signal. The blade-passing pulse signal is a signal in which the timing when a rotational blade passes through a certain point is recorded, and is, for example, a signal in which the presence or absence of the blade is output by 0/1 using an optical sensor. The blade drive current signal is a current signal for driving the fan 200. For example, the blade drive current signal is a current signal applied to a motor that rotates the fan 200.

In FIG. 26, a signal r is a reference signal. A signal u is a drive signal for driving the sound wave sources 106 to emit a control sound for reducing the noise generated in the target Lobe mode. A control filter K is an adaptive filter that converts the reference signal r into the drive signal u. The drive signal u is sent to the sound wave sources 106 through the drive circuit 152 as shown in, for example, FIG. 8 or 9. A signal e is an error signal obtained by the sound collection device 404. Specifically, the error signal e is obtained by combining the output signals of the microphones 304 by the processing circuit as shown in FIG. 23 or 24.

A signal x is an auxiliary signal and is obtained by converting the reference signal r by a filter having a secondary path characteristic C. The secondary path characteristic C is a transmission characteristic from the drive signal u to the error signal e when no noise is generated. A signal $u_d$ is an auxiliary signal, and is obtained by subtracting, from a signal obtained by converting the auxiliary signal x by the control filter K, a signal obtained by converting the drive signal u by a filter having the secondary path characteristic C.

A control circuit 452 generates the drive signal u based on the error signal e and the reference signal r. As an ANC algorithm, a known ANC algorithm such as normal Filtered-X or input constraint can be used. Therefore, a detailed description of generation of the drive signal u will be omitted.

In the normal Filtered-X, the control filter K is updated to minimize evaluation function J(t):

$$J(t)=e^2(t)$$

where e(t) is the error signal at time t.

In this case, the update rule of the control filter K is derived into:

$$K(t+1) = K(t) - \frac{2\mu e(t)\phi_x}{|\phi_x|^2 + \beta} \tag{6}$$

where μ is the step size in the gradient descent, β is an arbitrary numerical value (>0), for example, 0.01, K(t) is the control filter K at the time t, and $\phi_x$ is time-series data of the auxiliary signal x. The control circuit 452 updates the control filter K based on the update rule of equation (6).

In the input constraint, the control filter K is updated to minimize the evaluation function J(t):

$$J(t)=e^2(t)+\alpha u_d^2(t)$$

where α is a variable from 0 to 1 that determines the degree of input constraint (no constraint for α=0 and the input constraint becomes larger as a approaches 1) (no constraint for α=0 and the input constraint becomes larger as a approaches 1), and $u_d(t)$ is the auxiliary signal $u_d$ at the time t.

In this case, the update rule of the control filter K is derived into:

$$K(t+1) = K(t) - \frac{2\mu(e(t) + \alpha u_d(t))\phi_x}{|\phi_x|^2 + \beta} \tag{7}$$

The control circuit 452 updates the control filter K based on the update rule of equation (7).

Figure 27:
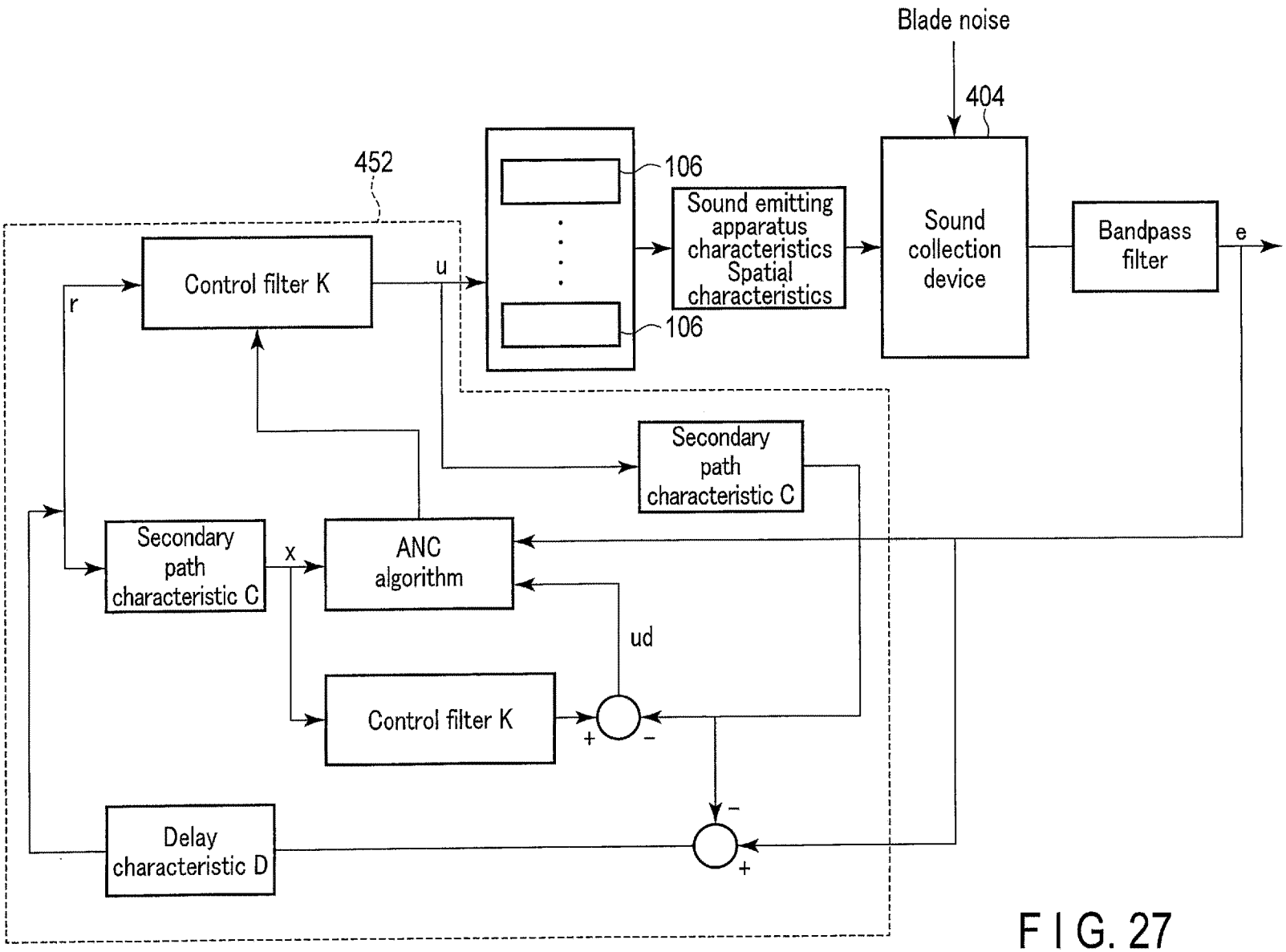
FIG. 27 is a block diagram showing another example of the control circuit included in the blade noise reduction apparatus shown in FIG. 25.

FIG. 27 schematically shows another example of the control circuit 452 of the blade noise reduction apparatus 400. In the example shown in FIG. 27, the control circuit 452 is based on feedback ANC. A detailed description of parts similar to those of the feedforward ANC will be omitted.

In FIG. 27, the error signal e is obtained by processing the error signal obtained by the sound collection device 404 by a bandpass filter. The bandpass filter is configured to extract a signal of a frequency band including a target frequency. The signal r is obtained by subtracting, from the error signal e, a signal obtained by converting the drive signal u by a filter having the secondary path characteristic C, and delaying the obtained signal by a predetermined time. The drive signal u is obtained by converting the signal r by the control filter K. The signal x is an auxiliary signal and is obtained by converting the signal r by a filter having the secondary path characteristic C. The signal $u_d$ is an auxiliary signal, and is obtained by subtracting, from a signal obtained by converting the auxiliary signal x by the control filter K, a signal obtained by converting the drive signal u by a filter having the secondary path characteristic C.

The control circuit 452 updates the control filter K based on the update rule of equation (6) or (7) described above.

When a phase difference between signals is obtained by delaying the signals by the delay units in the sound emitting apparatus 402 and/or the sound collection device 404, the delay time needs to be set again every time the target frequency changes. If the delay time changes, the secondary path characteristic changes, so the change in secondary path characteristic needs to be estimated. The estimation can be performed by calculation, database extraction, or online estimation.

To the contrary, when a phase difference between signals is obtained by applying the phase shift to the signals by the phase shifter in each of the sound emitting apparatus 402 and the sound collection device 404, no phase shift amount need be set again even upon a change in target frequency. Hence, no complicated processing is required. Since no secondary path characteristic changes, the use of a complicated ANC algorithm can be avoided. This is a great advantage in feedback ANC in which it is difficult to apply online estimation.

A frequency fi of the blade noise can be expressed by:

$$fi = \frac{Bx\Omega}{2\pi}$$

where B is the number of blades, Ω is the blade rotation speed [rad/s], and x is the order of the Lobe mode.

When the blades include only rotational blades, there is one Lobe mode for one frequency fi. When the blades include rotational and stationary blades, there are $M_0$ Lobe modes for one frequency fi, where $M_0$=Bx−pV, V is the number of stationary blades, and p is an integer.

The blade noise includes noises generated in many Lobe modes.

Since the mode separation is executed by frequency separation, the number of microphones may be one when the blades include only rotational blades. However, in an actual environment, there is the influence of environmental reflection. Therefore, mode separation processing using 2M+1 or more microphones is required.

When L Lobe modes (fi, Mi) are driven, the blade noise reduction apparatus 400 includes L sound emitting apparatuses 402 and L control circuits, where L is an integer of 2 or more. The Lobe mode (fi, Mi) represents a Mith-order Lobe mode having the frequency fi. For example, each sound emitting apparatus 402 includes the hollow tube 102 having a tube line length dependent on the corresponding target frequency fi. Each control circuit may be the control circuit as shown in FIG. 26 or 27. An error signal input to each control circuit is a signal related to the corresponding Lobe mode (fi, Mi).

[Passive Sound Absorber]

The blade noise reduction apparatus according to the embodiment may use a passive sound absorber together with the sound emitting apparatus.

Figure 28:
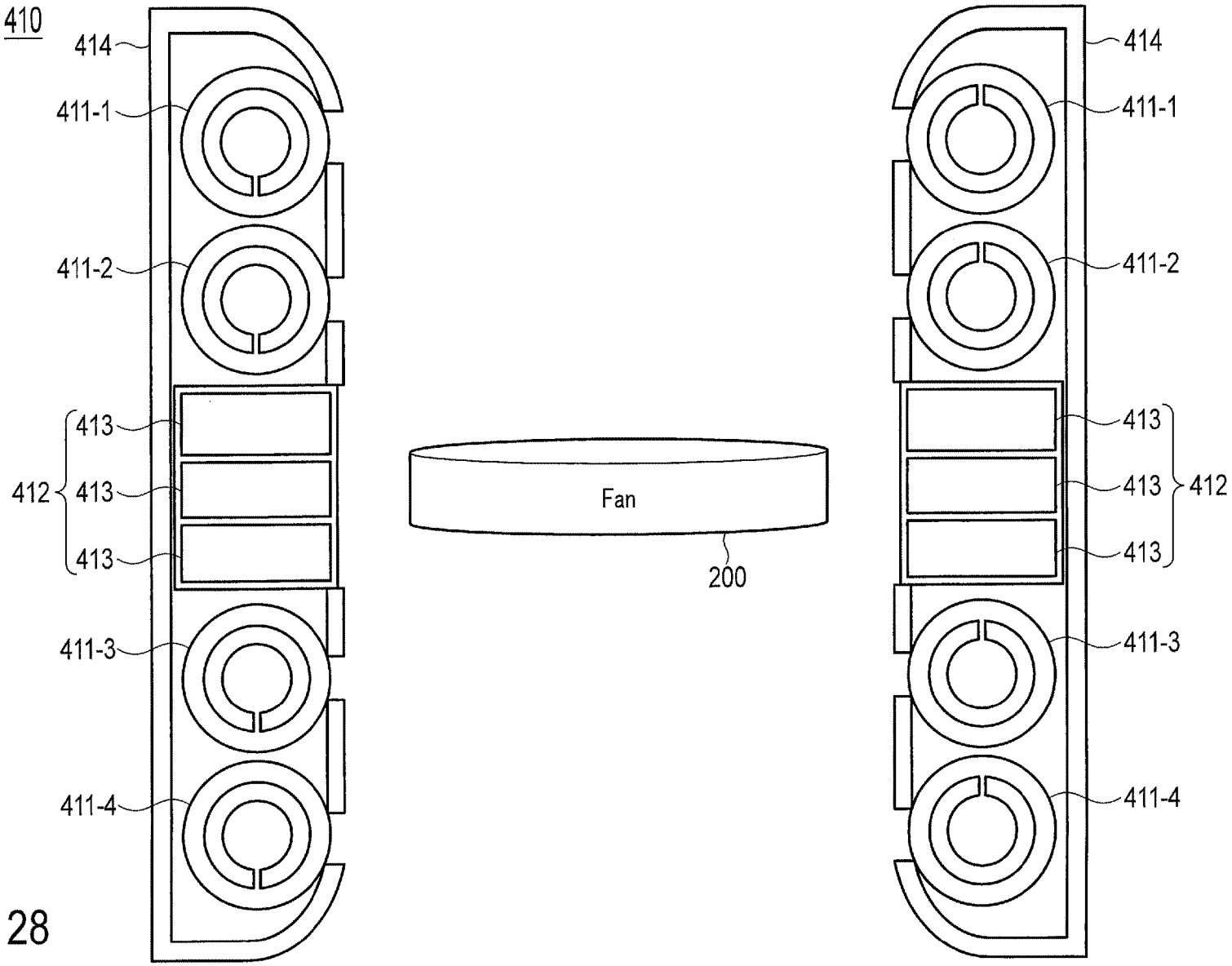
FIG. 28 is a sectional view showing the sound emitting apparatus according to an embodiment.

FIG. 28 schematically shows a blade noise reduction apparatus 410 according to an embodiment. As shown in FIG. 28, the blade noise reduction apparatus 410 includes sound emitting apparatuses 411-1, 411-2, 411-3, and 411-4, a passive sound absorber 412, and a cover 414. The cover 414 covers the sound emitting apparatuses 411-1, 411-2, 411-3, and 411-4 and the passive sound absorber 412 to prevent the disturbance of the flow of the rotational blades included in the fan 200.

Each of the sound emitting apparatuses 411-1, 411-2, 411-3, and 411-4 can have, for example, a configuration similar to that of the sound emitting apparatus 100 shown in FIGS. 1 and 2. The sound emitting apparatuses 411-1 and 411-4 are configured to drive a Lobe mode (fa, Ma), and the sound emitting apparatuses 411-2 and 411-3 are configured to drive a Lobe mode (fb, Mb).

The passive sound absorber 412 includes a plurality of sound absorbers 413 arranged to surround the fan 200. Each sound absorber 413 includes a Helmholtz resonator. The passive sound absorber 412 is configured to reduce noise in, for example, the 0th-order Lobe mode.

Figure 29:
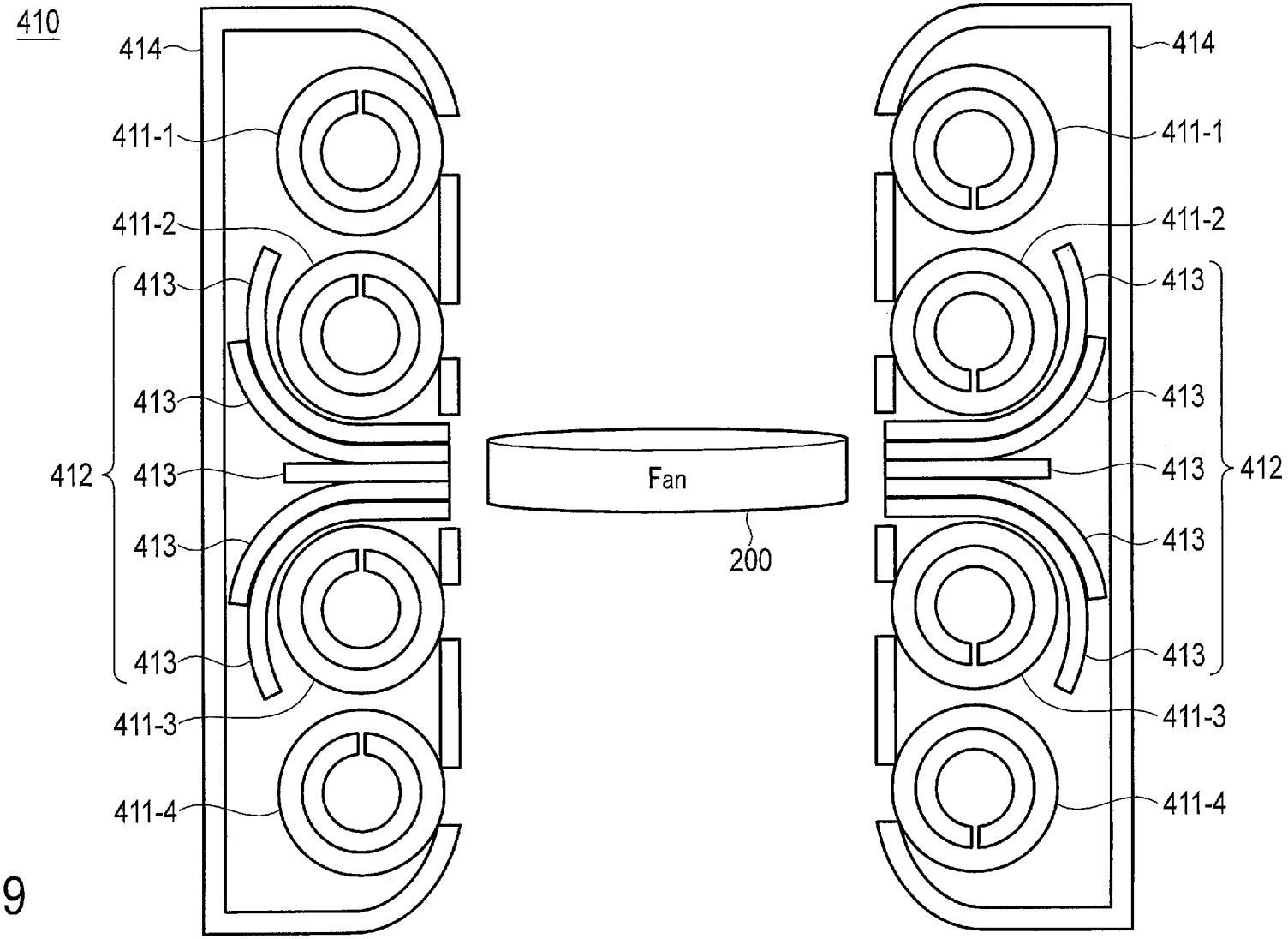
FIG. 29 is a sectional view showing the sound emitting apparatus according to an embodiment.

A slit sound absorber may be used as the sound absorber 413. When the sound absorber 413 is the slit type, the slit of the sound absorber 413 may be curved for space saving, as shown in FIG. 29.

A combination of the sound emitting apparatuses and the passive sound absorber according to the embodiment can more effectively reduce noise generated by the fan 200.

[Modification]

Figure 30:
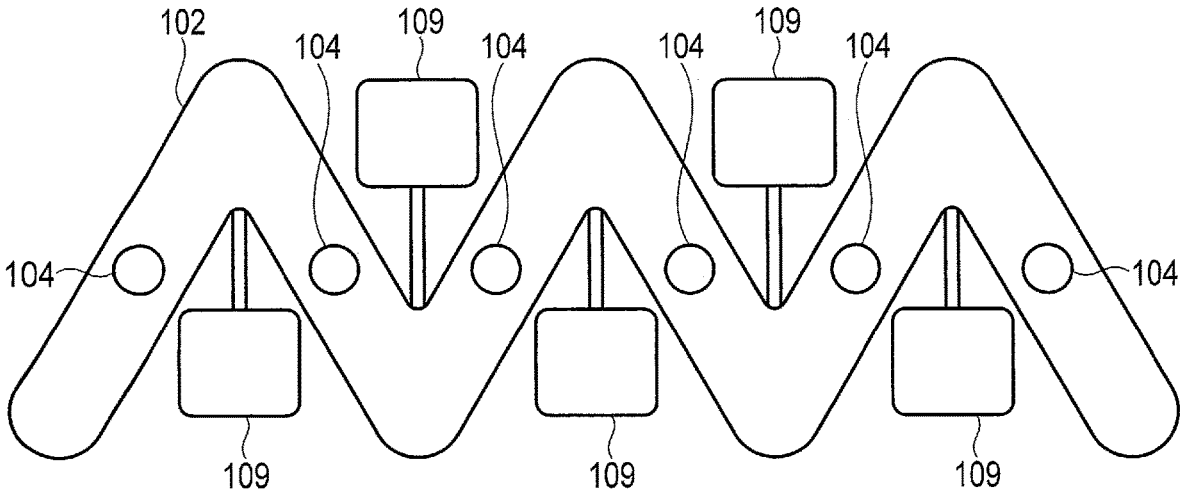
FIG. 30 is a side view showing part of the sound emitting apparatus according to an embodiment.

The hollow tube 102 is not limited to a helical hollow tube. FIG. 30 schematically shows part of the sound emitting apparatus 100 when viewed from the center (fan 200). As shown in FIG. 30, the hollow tube 102 may be a hollow tube zigzagged at turns. Since a sound wave is reflected at the turns, the curvature of the curve is minimized.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sound emitting apparatus comprising:

a first helical hollow tube helically extending in a circumferential direction to form an annular shape as a whole, the first helical hollow tube including a plurality of openings;

at least three sound wave sources coupled to the first helical hollow tube and configured to supply a sound wave to the first helical hollow tube; and a circular or oval supporting member supporting the first helical hollow tube, the first helical hollow tube being helically wound on the supporting member.

2. The apparatus according to claim 1, wherein the at least three sound wave sources are provided inside the supporting member.

3. The apparatus according to claim 1, further comprising a cover covering the first helical hollow tube.

4. The apparatus according to claim 1, wherein the openings have a dimension at which Helmholtz resonance occurs.

5. The apparatus according to claim 1, wherein the first helical hollow tube has a tube line length dependent on a frequency subjected to noise reduction.

6. A sound emitting apparatus comprising:

a first helical hollow tube helically extending in a circumferential direction to form an annular shape as a whole, the first helical hollow tube including a plurality of openings; and at least three sound wave sources coupled to the first helical hollow tube and configured to supply a sound wave to the first helical hollow tube, wherein the at least three sound wave sources include at least 2M+1 sound wave sources, where M is an order of a Lobe mode subjected to noise reduction.

7. The apparatus according to claim 6, wherein the at least three sound wave sources are 3M sound wave sources, and the 3M sound wave sources are implemented by 3M/2 loudspeakers.

8. The apparatus according to claim 6, wherein the first helical hollow tube has a tube line length dependent on a frequency subjected to noise reduction.

9. A sound emitting apparatus comprising:

a first helical hollow tube helically extending in a circumferential direction to form an annular shape as a whole, the first helical hollow tube including a plurality of openings;

at least three sound wave sources coupled to the first helical hollow tube and configured to supply a sound wave to the first helical hollow tube; and a second helical hollow tube helically extending in the circumferential direction to form an annular shape as a whole, the second helical hollow tube including a plurality of openings, wherein the first helical hollow tube and the second helical hollow tube have a double helical structure.

10. The apparatus according to claim 9, wherein the first helical hollow tube has a tube line length dependent on a frequency subjected to noise reduction.

* * * * *